US011091344B2

(12) United States Patent
Ueno et al.

(10) Patent No.: US 11,091,344 B2
(45) Date of Patent: Aug. 17, 2021

(54) MEDIUM TRANSPORT DEVICE, MEDIUM PROCESSING APPARATUS, AND CONTROL METHOD OF MEDIUM TRANSPORT DEVICE

(71) Applicant: SEIKO EPSON CORPORATION, Tokyo (JP)

(72) Inventors: Kohei Ueno, Matsumoto (JP); Nobuyuki Mizushima, Shiojiri (JP); Yutaro Harada, Shiojiri (JP); Shunpei Yamaguchi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/696,891

(22) Filed: Nov. 26, 2019

(65) Prior Publication Data

US 2020/0171857 A1 Jun. 4, 2020

(30) Foreign Application Priority Data

Nov. 30, 2018 (JP) ..... JP2018-225128

(51) Int. Cl.

| | |
|---|---|
| ***B65H 31/10*** | (2006.01) |
| ***B65H 31/34*** | (2006.01) |
| ***B65H 31/36*** | (2006.01) |
| ***B65H 31/04*** | (2006.01) |

(52) U.S. Cl.

CPC ..... *B65H 31/10* (2013.01); *B65H 31/04* (2013.01); *B65H 31/34* (2013.01); *B65H 31/36* (2013.01); *B65H 2301/45* (2013.01); *B65H 2301/4505* (2013.01)

(58) Field of Classification Search

CPC ..... B65H 31/04; B65H 31/10; B65H 31/34; B65H 31/36; B65H 2301/45; B65H 2301/4505

USPC ..... 270/58.08, 58.09, 37

See application file for complete search history.

(56) References Cited

U.S. PATENT DOCUMENTS

| | | | | |
|---|---|---|---|---|
| 6,145,825 | A * | 11/2000 | Kunihiro | B42C 1/12 270/58.09 |
| 7,413,181 | B2 * | 8/2008 | Iida | G03G 15/6552 270/37 |
| 7,455,291 | B2 * | 11/2008 | Reeves | B65H 9/06 271/181 |
| 7,475,874 | B2 * | 1/2009 | Sato | B65H 29/001 270/58.09 |
| 7,571,904 | B2 * | 8/2009 | Bober | B65H 31/36 270/58.07 |

(Continued)

FOREIGN PATENT DOCUMENTS

JP 2010-001149 1/2010

*Primary Examiner* — Leslie A Nicholson, III

(74) *Attorney, Agent, or Firm* — Workman Nydegger

(57) ABSTRACT

A medium transport device includes a feed roller pair, a stack portion that receives a medium transported by the feed roller pair between a support surface for supporting the medium in an inclined posture in which a downstream side in a transport direction is directed downward and an opposing surface opposing the support surface and stacks the medium, an alignment portion that aligns a downstream end of the medium stacked in the stack portion, and a control unit that controls a distance between the support surface and the opposing surface, in which the stack portion is configured to be capable of changing the distance and the control unit adjusts the distance according to a condition.

20 Claims, 12 Drawing Sheets

(56) References Cited

U.S. PATENT DOCUMENTS

| | | | | |
|---|---|---|---|---|
| 7,690,633 | B2 * | 4/2010 | Tamura | B65H 37/04<br>270/37 |
| 7,753,353 | B2 * | 7/2010 | McNamara | B65H 31/00<br>270/37 |
| 7,954,800 | B2 * | 6/2011 | Maeda | B65H 31/10<br>270/58.11 |
| 8,087,667 | B2 * | 1/2012 | Sekigawa | G03G 15/6529<br>271/220 |
| 2008/0315494 | A1 * | 12/2008 | Terao | B65H 31/02<br>270/58.12 |
| 2009/0134563 | A1 * | 5/2009 | Watanabe | B65H 31/26<br>270/45 |

* cited by examiner

MEDIUM TRANSPORT DEVICE, MEDIUM PROCESSING APPARATUS, AND CONTROL METHOD OF MEDIUM TRANSPORT DEVICE

The present application is based on, and claims priority from JP Application Serial Number 2018-225128, filed Nov. 30, 2018, the disclosure of which is hereby incorporated by reference herein in its entirety.

BACKGROUND

1. Technical Field

The present disclosure relates to a medium transport device for transporting a medium, and a medium processing apparatus including the medium transport device.

2. Related Art

Among medium processing apparatuses that perform predetermined processing on a medium, there is one configured to be capable of forming a booklet by performing saddle-stitching processing in which the center of a plurality of sheets media in the width direction is bound and then the media is folded at a binding position.

Such a medium processing apparatus may be incorporated into a recording system which can execute continuously from recording on the medium by a recording device to the saddle-stitching processing.

Among the medium processing apparatuses, there is one configured to include a medium transport device that transports the medium before the saddle-stitching processing and stacks the medium in a stack portion and perform the saddle-stitching processing after an end portion of the medium placed in the stack portion is abutted against an alignment portion and aligned.

As an example, JP-A-2010-001149 discloses a medium transport device including a stack portion that stacks a medium and an alignment portion that aligns an end portion of the medium placed in the stack portion. The stack portion is configured to stack the medium between a support surface that supports the medium and an opposing surface that opposes the support surface. In JP-A-2010-001149, the stack portion is a compile tray 441 and the alignment portion is an end guide 443.

When the number of stacked media in the stack portion increases, a space between the topmost medium of the stack portion and the opposing surface narrows. In such a situation, the media to be sent next to the stack portion may be susceptible to frictional resistance with the topmost media and may not be transported until the end portion abuts against the alignment portion. Depending on a type or state of the medium, even if the number of stacked media in the stack portion is small, there is a possibility that a transport failure occurs.

If an interval between the support surface and the opposing surface is originally wide, trouble described above is suppressed, but if the space between the topmost medium of the stack portion and the opposing surface is wide, there is a possibility that the medium is lifted and alignment of the medium is degraded.

SUMMARY

According to an aspect of the present disclosure, there is provided a medium transport device including a feeding unit that transports a medium, a stack portion that receives the medium transported by the feeding unit between a support surface for supporting the medium in an inclined posture in which a downstream side in a transport direction is directed downward and an opposing surface opposing the support surface and stacks the medium, an alignment portion that aligns a downstream end of the medium stacked in the stack portion, and a control unit that controls a distance between the support surface and the opposing surface, in which the stack portion is configured to be capable of changing the distance and the control unit adjusts the distance according to a condition.

DESCRIPTION OF EXEMPLARY EMBODIMENTS

Figure 1:
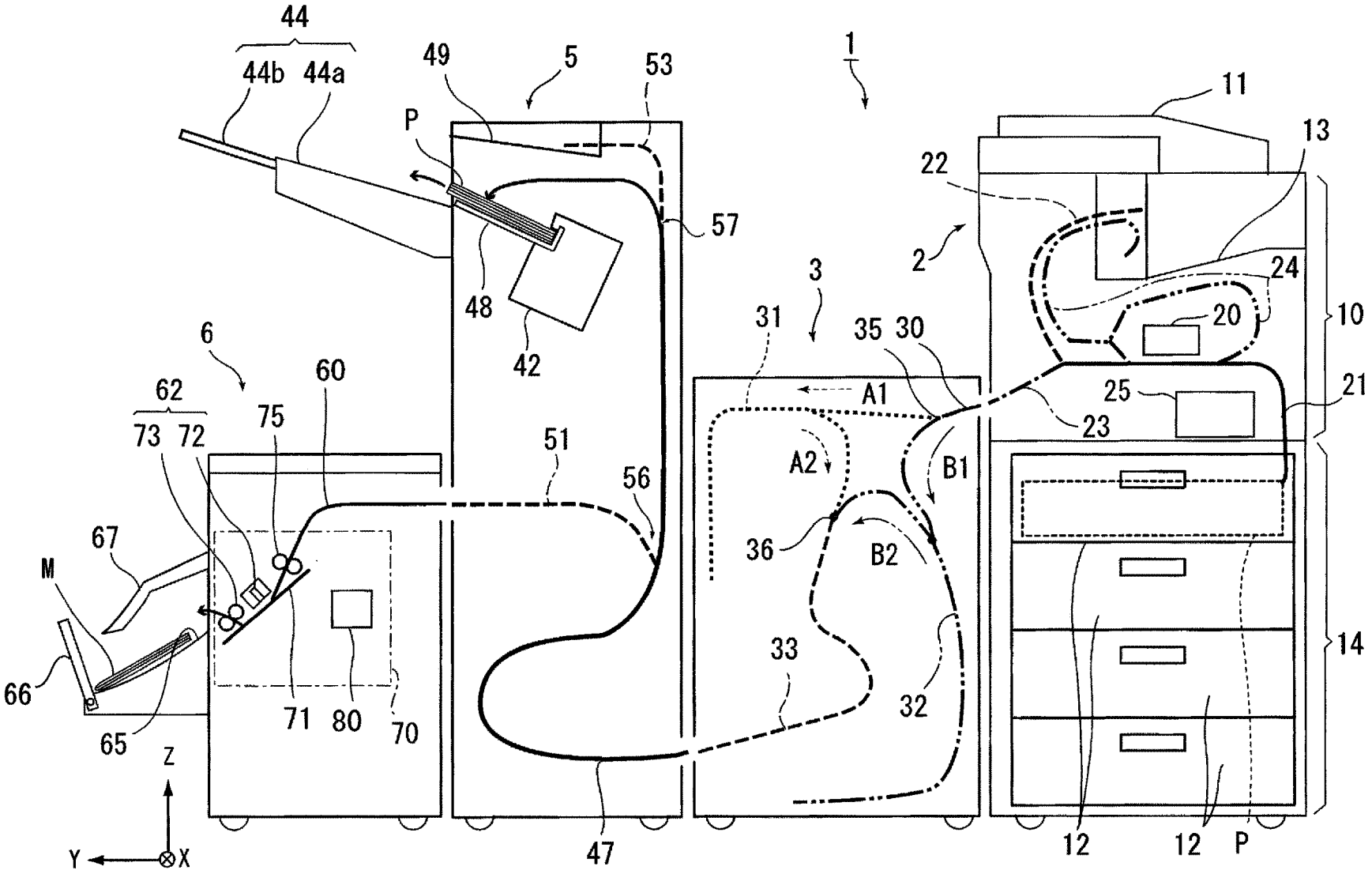
FIG. 1 is a schematic view of a recording system.

Hereinafter, the present disclosure will be schematically described.

According to a first aspect of the present disclosure, there is provided a medium transport device including a feeding unit that transports a medium, a stack portion that receives the medium transported by the feeding unit between a support surface for supporting the medium in an inclined posture in which a downstream side in a transport direction is directed downward and an opposing surface opposing the support surface and stacks the medium, an alignment portion that aligns a downstream end of the medium stacked in the stack portion, and a control unit that controls a distance between the support surface and the opposing surface, in which the stack portion is configured to be capable of changing the distance and the control unit adjusts the distance according to a condition.

According to the first aspect, the stack portion is configured to be capable of changing the distance between the support surface and the opposing surface and the control unit that controls the distance adjusts the distance according to a condition, and thus the medium can be appropriately stacked in the stack portion.

A second aspect of the present disclosure provides the medium transport device according to the first aspect, in which the control unit may use, as the condition, any of a type of the medium to be stacked, the number of stacked media previously stacked in the stack portion, a stack height of the medium previously stacked in the stack portion, and a discharge amount of liquid to the medium when the medium transported by the feeding unit is a recorded medium to which the liquid is discharged for recording.

According to the second aspect, the medium can be appropriately stacked in the stack portion by changing the distance between the support surface and the opposing surface using, as the condition, any of the type of the medium to be stacked, the number of stacked media previously stacked in the stack portion, the stack height of the medium previously stacked in the stack portion, and the discharge amount of liquid to the medium when the medium transported by the feeding unit is the recorded medium to which the liquid is discharged for recording.

A third aspect of the present disclosure provides the medium transport device according to the first aspect, in which the control unit may use a plurality of conditions as the condition.

According to the third aspect, since the plurality of conditions are used as the condition, the medium can be appropriately stacked in the stack portion by changing the distance between the support surface and the opposing surface more appropriately.

A fourth aspect of the present disclosure provides the medium transport device according to the third aspect, in which the plurality of conditions may include two or more of the type of the medium to be stacked, a temperature in an installation environment of the device, a humidity in the installation environment, the number of stacked media previously stacked in the stack portion, and the discharge amount of liquid to the medium when the medium transported by the feeding unit is a recorded medium to which the liquid is discharged for recording.

According to the fourth aspect, the medium can be appropriately stacked in the stack portion by changing the distance between the support surface and the opposing surface more appropriately based on two or more of the plurality of conditions.

A fifth aspect of the present disclosure provides the medium transport device according to the fourth aspect, in which the control unit may use the type of the medium and the number of stacked media previously stacked in the stack portion as the plurality of conditions, set the distance between the support surface and the opposing surface to a first distance in stacking the medium when the number of stacked media is less than a predetermined threshold value according to the type of the medium, and set the distance between the support surface and the opposing surface to a second distance longer than the first distance in stacking the medium when the number of stacked media is equal to or greater than the predetermined threshold value according to the type of the medium.

Since the stack portion stacks the medium in an inclined posture in which a downstream side in the transport direction is directed downward, when the number of stacked media previously stacked in the stack portion is small, the medium is easy to move toward the alignment portion by its own weight. On the other hand, when the number of stacked media increases and a space between the top medium and the opposing surface narrows, frictional resistance between the top medium and a subsequent medium to be sent next to the stack portion is likely to occur, and the subsequent medium is difficult to move toward the alignment portion by its own weight.

The number of stacked media that makes it difficult for the medium to move toward the alignment portion by its own weight changes depending on the type of the medium.

According to the fifth aspect, since the control unit uses the type of the medium and the number of stacked media previously stacked in the stack portion as the plurality of conditions, sets the distance between the support surface and the opposing surface as the first distance in stacking the medium when the number of stacked media is less than a predetermined threshold value according to the type of the medium, and sets the distance between the support surface and the opposing surface as the second distance longer than the first distance in stacking the medium when the number of stacked media is equal to or greater than the predetermined threshold value according to the type of the medium, even if the number of stacked media increases, the distance between the top medium and the opposing surface can be secured and the medium can be appropriately stacked in the stack portion.

A sixth aspect of the present disclosure provides the medium transport device according to the fourth aspect, in which the control unit may use as the plurality of conditions the discharge amount of liquid to the medium and the number of stacked media in the stack portion, set the distance between the support surface and the opposing surface to a first distance in stacking the medium when the number of stacked media is less than a predetermined threshold value according to the discharge amount of the liquid to the medium, and set the distance between the support surface and the opposing surface to a second distance longer than the first distance in stacking the medium when the number of stacked media is equal to or greater than the predetermined threshold value according to the discharge amount of the liquid to the medium.

As described above, when the number of stacked media increases and the space between the top medium and the opposing surface narrows, frictional resistance between the top medium and a subsequent medium to be sent next to the stack portion is likely to occur, and the subsequent medium is difficult to move toward the alignment portion by its own weight. Since the frictional resistance between the media changes according to the discharge amount of the liquid to the medium, the number of stacked media that makes it difficult for the medium to move toward the alignment portion by its own weight changes according to the discharge amount of the liquid to the medium.

According to the sixth aspect, since the control unit uses the discharge amount of the liquid to the medium and the number of stacked media in the stack portion, sets the distance between the support surface and the opposing surface as a first distance in stacking the medium when the number of stacked media is less than a predetermined threshold value according to the discharge amount of the liquid to the medium, and sets the distance between the support surface and the opposing surface as a second distance longer than the first distance in stacking the medium when the number of stacked media is equal to or greater than the predetermined threshold value according to the discharge amount of the liquid to the medium, even if the number of stacked media increases, the distance between the top medium and the opposing surface can be secured and the medium can be appropriately stacked in the stack portion.

A seventh aspect of the present disclosure provides the medium transport device according to the sixth aspect, in which the threshold value of the number of stacked media may be set to be lower as the discharge amount of the liquid to the medium increases.

Since the frictional resistance between the media increases as the discharge amount of the liquid to the medium increases, even if the number of stacked media in the stack portion is small, the medium is difficult to move toward the alignment portion by its own weight.

According to the seventh aspect, since the threshold value of the number of stacked media is set lower as the discharge amount of the liquid to the medium increases, a possibility of a transport failure of the medium in the stack portion can be avoided more reliably.

An eighth aspect of the present disclosure provides the medium transport device according to any of the first to seventh aspects, in which the distance between the support surface and the opposing surface is changed by displacing the opposing surface in an advancing and retreating direction in which the opposing surface advances and retreats with respect to the support surface.

According to the eighth aspect, the distance between the support surface and the opposing surface can be changed by displacing the opposing surface in the advancing and retreating direction with respect to the support surface.

A ninth aspect of the present disclosure provides the medium transport device according to the eighth aspect, which may further include a paddle which is provided between the feeding unit and the alignment portion in the transport direction and moves the medium toward the alignment portion by rotating while being in contact with the medium, and in which the paddle may be configured to be displaceable in the advancing and retreating direction, and may be displaced in the same direction as a displacement direction of the opposing surface when the opposing surface is displaced.

According to the ninth aspect, since the paddle is configured to be displaceable in the advancing and retreating direction and is displaced in the same direction as a displacement direction of the opposing surface when the opposing surface is displaced, the paddle can be more appropriately brought into contact with the medium.

A tenth aspect of the present disclosure provides the medium transport device according to the ninth aspect, in which the paddle may include a first paddle and a second paddle provided at an interval in a width direction intersecting the transport direction, and in which the first paddle and the second paddle may be disposed such that phases in a circumferential direction of a rotation shaft are different from each other.

Although the paddle rotates while being in contact with the medium to send the medium in the transport direction, a contact angle of the rotating paddle with respect to the medium changes, and thus a wave (velocity unevenness) may occur in a transport speed of the medium.

According to the tenth aspect, since the paddle includes the first paddle and the second paddle provided at intervals in a width direction intersecting the transport direction and the first paddle and the second paddle are disposed such that phases in the circumferential direction of the rotation shaft are different from each other, the wave of the transport velocity of the medium generated by the first paddle and the wave of the transport velocity generated by the second paddle are offset. Accordingly, the transport speed of the medium can be made uniform as a whole.

An eleventh aspect of the present disclosure provides the medium transport device according to the first to tenth aspects, in which the alignment portion may include an eaves portion opposing a downstream end region of the medium stacked in the stack portion, and a distance between the eaves portion and the support surface may be longer than the distance between the support surface and the opposing surface.

According to the eleventh aspect, since the alignment portion includes the eaves portion opposing the downstream end region of the medium stacked in the stack and the distance between the eaves portion and the support surface is longer than the distance between the support surface and the opposing surface, the medium can be reliably guided between the eaves portion and the support surface and the downstream end of the medium can be brought into contact with the alignment portion.

According to a twelfth aspect of the present disclosure, there is provided a medium processing apparatus including the medium transport device according to the first to eleventh aspects and a processing unit that performs processing on the medium stacked in the stack portion.

According to the twelfth aspect, the same function and effect as any of the first to eleventh aspects can be obtained in the medium processing apparatus including the medium transport device according to the first to eleventh aspects and the processing unit that performs processing on the medium stacked in the stack portion.

A thirteenth aspect of the present disclosure provides the medium processing apparatus according to the twelfth aspect, in which the processing unit may include a binding unit that binds the medium and a folding unit that folds the medium at a binding position by the binding unit.

According to the thirteenth aspect, the same function and effect as the twelfth aspect can be obtained in the medium processing apparatus in which the processing unit includes the binding unit that binds the medium and the folding unit that folds the medium at the binding position by the binding unit.

According to a fourteenth aspect of the present disclosure, there is provided a control method of a medium transport device including transporting, by a feeding unit, a medium, receiving, by a stack portion, the medium transported by the feeding unit between a support surface for supporting the medium in an inclined posture in which a downstream side in a transport direction is directed downward and an opposing surface opposing the support surface and stacking, by the stack portion, the medium, aligning, by an alignment portion, a downstream end of the medium stacked in the stack portion, and controlling, by a control unit, a position of the opposing surface, in which the control unit changes a distance between the support surface of the stack portion and the opposing surface according to a condition.

A fifteenth aspect of the present disclosure provides the control method of the medium transport device according to the fourteenth aspect, the control unit may use, as the condition, any of a type of the medium to be stacked, the number of stacked media previously stacked in the stack portion, stack height of the medium previously stacked in the stack portion, a discharge amount of liquid to the medium when the medium transported by the feeding unit is a recorded medium to which the liquid is discharged for recording.

A sixteenth aspect of the present disclosure provides the control method of the medium transport device according to the fourteenth aspect, the control unit may use a plurality of conditions as the condition.

A seventeenth aspect of the present disclosure provides the control method of the medium transport device according to the sixteenth aspect, in which the plurality of conditions include two or more of the type of the medium to be stacked, temperature in an installation environment of the device an apparatus, a humidity in the installation environment, the number of stacked media previously stacked in the stack portion, and a discharge amount of liquid to the medium when the medium transported by the feeding unit is a recorded medium to which the liquid is discharged for recording.

An eighteenth aspect of the present disclosure provides the control method of the medium transport device according to any of the fourteenth to seventeenth aspects, in which the control unit may change the distance between the support surface and the opposing surface by displacing the opposing surface in an advancing and retreating direction in which the opposing surface advances and retreats with respect to the support surface.

A nineteenth aspect of the present disclosure provides the control method of the medium transport device medium transport device according to the eighteenth aspect, wherein the transport device includes a paddle that is provided between the feeding unit and the alignment portion in the transport direction and moves the medium toward the alignment portion by rotating while being in contact with the medium, the method may further include moving, by the paddle, the medium toward the alignment portion, and the control unit may displace the paddle in the same direction as a displacement direction of the opposing surface when displacing the opposing surface.

First Embodiment

Hereinafter, a first embodiment will be described with reference to the drawings. In the XYZ coordinate system illustrated in each drawing, the X-axis direction indicates an apparatus depth direction, the Y-axis direction indicates an apparatus width direction, and the Z-axis direction indicates an apparatus height direction.

Overview of Recording System

As an example, a recording system 1 illustrated in FIG. 1 includes a recording unit 2, an intermediate unit 3, a first unit 5, and a second unit 6 in order from the right to the left in FIG. 1. In this embodiment, the second unit 6 is a "medium processing apparatus" that performs saddle-stitching processing on a medium.

The recording unit 2 performs recording on the transported medium. The intermediate unit 3 receives a recorded medium from the recording unit 2 and delivers the medium to the first unit 5. The first unit 5 performs end-stitching processing to bundle received media and bind ends of the media, or passes the received medium as it is and delivers the received medium to the second unit 6. The second unit 6 includes a medium transport device 70 for transporting a medium, and performs saddle-stitching processing in which the center of the medium is bound and folded to form a booklet.

Hereinafter, description will be made in detail in order of the recording unit 2, the intermediate unit 3, the first unit 5, and the second unit 6 (medium processing apparatus).

About Recording Unit

The recording unit 2 will be described with reference to FIG. 1. The recording unit 2 is configured as a multifunction machine including a printer unit 10 having a line head 20 as a recording unit that performs recording on a medium, and a scanner unit 11. In this embodiment, the line head 20 is configured as a so-called ink jet recording head that performs recording by discharging ink, which is liquid, onto the medium.

Below the printer unit 10, a cassette storage unit 14 including a plurality of medium accommodation cassettes 12 is provided. The medium P accommodated in the medium accommodation cassette 12 is fed to a recording area by the line head 20 through a feeding path 21 indicated by a solid line in FIG. 1 and a recording operation is performed. The medium after being recording by the line head 20 is sent to a first discharge path 22 for discharging the medium to a discharge tray 13 for a recorded medium provided above the line head 20 or a second discharge path 23 for sending the medium to the intermediate unit 3.

In FIG. 1, the first discharge path 22 is indicated by a broken line, and the second discharge path 23 is indicated by a one-dot chain line. The second discharge path 23 extends in the +Y direction of the recording unit 2 and delivers the medium to a receiving path 30 of the adjacent intermediate unit 3.

The recording unit 2 is provided with a reversing path 24 indicated by a two-dot chain line in FIG. 1, and is configured to be capable of double-sided recording in which recording is performed on the second side of the medium by reversing the recorded medium on the first side of the medium. In each of the feeding path 21, the first discharge path 22, the second discharge path 23, and the reversing path 24, one or more pairs of transport rollers (not illustrated) are disposed as an example of a unit for transporting the medium.

The recording unit 2 is provided with a first control unit 25 that controls an operation related to transport and recording of the medium in the recording unit 2. The recording system 1 is configured such that the recording unit 2, the intermediate unit 3, the first unit 5, and the second unit 6 are mechanically and electrically connected to each other and the medium can be transported from the recording unit 2 to the second unit 6. The first control unit 25 can control various operations in the intermediate unit 3, the first unit 5, and the second unit 6 connected to the recording unit 2.

The recording system 1 is configured to be able to input settings in the recording unit 2, the intermediate unit 3, the first unit 5, and the second unit 6 from an operation panel (not illustrated). The operation panel can be provided in the recording unit 2 as an example.

About Intermediate Unit

The intermediate unit 3 will be described with reference to FIG. 1. The intermediate unit 3 illustrated in FIG. 1 delivers the medium received from the recording unit 2 to the first unit 5. The intermediate unit 3 is disposed between the recording unit 2 and the first unit 5. The medium transported through the second discharge path 23 of the recording unit 2 is received by the intermediate unit 3 from the receiving path 30 and transported toward the first unit 5. The receiving path 30 is indicated by a solid line in FIG. 1.

In the intermediate unit 3, there are two transport paths for transporting the medium. The first transport path is a path through which the medium is transported from the receiving path 30 to a joining path 33 through a first switchback path 31 indicated by a dotted line in FIG. 1. The second path is a path through which the medium is transported from the receiving path 30 to the joining path 33 through a second switchback path 32 indicated by a two-dot chain line in FIG. 1.

The first switchback path 31 is a path for switching back the medium in the arrow A2 direction after receiving the medium in the arrow A1 direction. The second switchback path 32 is a path for switching back the medium in the arrow B2 direction after receiving the medium in the arrow B1 direction.

The receiving path 30 branches into the first switchback path 31 and the second switchback path 32 at a branch portion 35. The branch portion 35 is provided with a flap (not illustrated) that switches a destination of the medium to either the first switchback path 31 or the second switchback path 32.

The first switchback path 31 and the second switchback path 32 join at a joining portion 36. Accordingly, even if the medium is sent from the receiving path 30 to either the first switchback path 31 or the second switchback path 32, the medium can be delivered to the first unit 5 through the common joining path 33.

The medium transported on the joining path 33 is delivered to the first transport path 47 of the first unit 5 from the +Y direction of the intermediate unit 3.

One or more pairs of the transport rollers (not illustrated) are disposed in each of the receiving path 30, the first switchback path 31, the second switchback path 32, and the joining path 33.

When recording is continuously performed on a plurality of media in the recording unit 2, the medium that has entered the intermediate unit 3 is alternately sent to the transport path passing through the first switchback path 31 and the transport path passing through the second switchback path 32. This can increase the throughput of medium transport in the intermediate unit 3.

In a case a configuration in which recording is performed by discharging ink (liquid) to the medium as in the line head 20 of this embodiment, if the medium is wet when processing is performed by the first unit 5 or the second unit 6 in a subsequent stage, a recording surface may be rubbed or consistency of the medium may be poor.

By delivering the recorded medium from the recording unit 2 to the first unit 5 through the intermediate unit 3, the transport time until the recorded medium is sent to the first unit 5 can be made long, and the medium can be further dried before reaching the first unit 5 or the second unit 6.

About First Unit

The first unit 5 will be described with reference to FIG. 1. The first unit 5 has a first transport path 47 connected to a first processing unit 42 that performs end-stitching processing, and a second transport path 51 that sends the received medium to the second unit 6 without passing through the first processing unit 42. The end-binding processing is, for example, processing for binding one corner of the medium or one side of one side of the medium. The second transport path 51 branches from the first transport path 47 at the first branch portion 56.

The first unit 5 includes a first tray 44 that receives the medium after end-stitching processing discharged from the first unit 5. The first tray 44 is provided so as to protrude from the first unit 5 in the +Y direction. In this embodiment, the first tray 44 includes a base portion 44*a* and an extension portion 44*b*, and the extension portion 44*b* is configured to be storable in the base portion 44*a*.

In this embodiment, the first processing unit 42 is a stapler that performs end-binding processing in which a plurality of media are superposed and the end portion is bound. The first processing unit 42 may be configured to perform punching processing or the like for forming a hole at a predetermined position of the medium.

The medium received by the first unit 5 is transported on the first transport path 47 illustrated by the solid line in FIG. 1. The medium P transported on the first transport path 47 is sent to the processing tray 48, and is stacked on the processing tray 48 with the rear end in the transport direction aligned. When a predetermined number of media P are stacked on the processing tray 48, the first processing unit 42 performs end-stitching processing on the rear end of the medium P. The medium after end-stitching processing is discharged to the first tray 44 by a discharging unit (not illustrated).

To the first transport path 47, a third transport path 53 branched from the first transport path 47 at the second branch portion 57 downstream of the first branch portion 56 is connected. The third transport path 53 is a path for discharging the medium to an upper tray 49 provided above the first unit 5. In the upper tray 49, the medium not subjected to processing can be stacked.

In each of the first transport path 47, the second transport path 51, and the third transport path 53, one or more pairs of transport rollers (not illustrated) are disposed as an example of a unit for transporting the medium. Each of the first branch portion 56 and the second branch portion 57 is provided with a flap (not illustrated) for switching the destination of the medium.

About Second Unit

Subsequently, the second unit 6 will be described. The second unit 6 illustrated in FIG. 1 includes the medium transport device 70. The medium delivered from the second transport path 51 of the first unit 5 is transported on the transport path 60 illustrated by the solid line in FIG. 1 and is sent to a second processing unit 62.

In the second processing unit 62, after the medium is bound, the saddle-stitching processing can be performed to fold the medium at the binding position into a booklet. The saddle-stitching processing by the medium transport device 70 and the second processing unit 62 will be described in detail later.

A bundle of media after the saddle-stitching processing is discharged to a second tray 65 illustrated in FIG. 1. The second tray 65 includes a restriction portion 66 at the tip in the +Y direction, which is a medium discharge direction, and suppresses that the bundle of media discharged to the second tray 65 protrudes from the second tray 65 or falls from the second tray 65 in the medium discharge direction. Reference numeral 67 denotes a guide portion 67 for guiding the bundle of media M discharged from the second unit 6 to the second tray 65.

About Medium Transport Device

The medium transport device 70 will be described with reference to FIGS. 1 to 3. The medium transport device 70 illustrated in FIG. 2 includes a feed roller pair 75 as a feeding unit for transporting the medium P, a stack portion 71 for stacking the medium P, and an alignment portion 76 for aligning a downstream end E1 (FIG. 3) of the medium P stacked in the stack portion 71, a paddle 81, and a control unit 80 (FIG. 1). The feed roller pair 75 includes a driving roller 75*a* and a driven roller 75*b* that is driven to rotate by rotation of the driving roller 75*a*, and the driving roller 75*a* is controlled by the control unit 80 to rotate.

Figure 2:
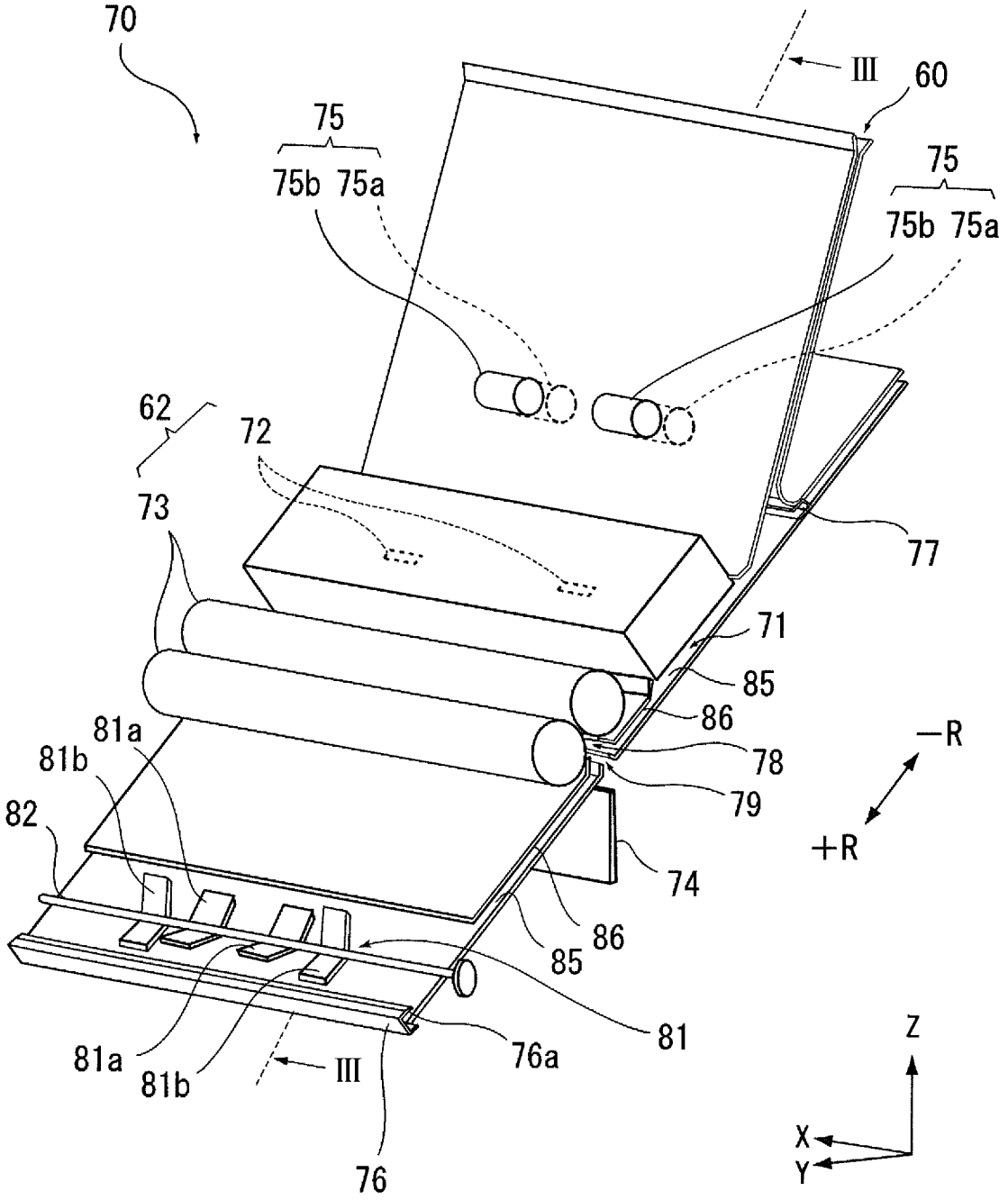
FIG. 2 is a schematic perspective view of a medium transport device.

In FIG. 2, the stack portion 71 receives and stacks the medium P transported by the feed roller pair 75 between a support surface 85 for supporting the medium in an inclined posture in which a downstream side in a transport direction +R is directed downward and an opposing surface 86 opposing the support surface 85. The paddle 81 is provided between the feed roller pair 75 and an alignment portion 76 in the transport direction +R, and moves the medium P toward the alignment portion 76 by rotating while being in contact with the medium P.

Figure 3:
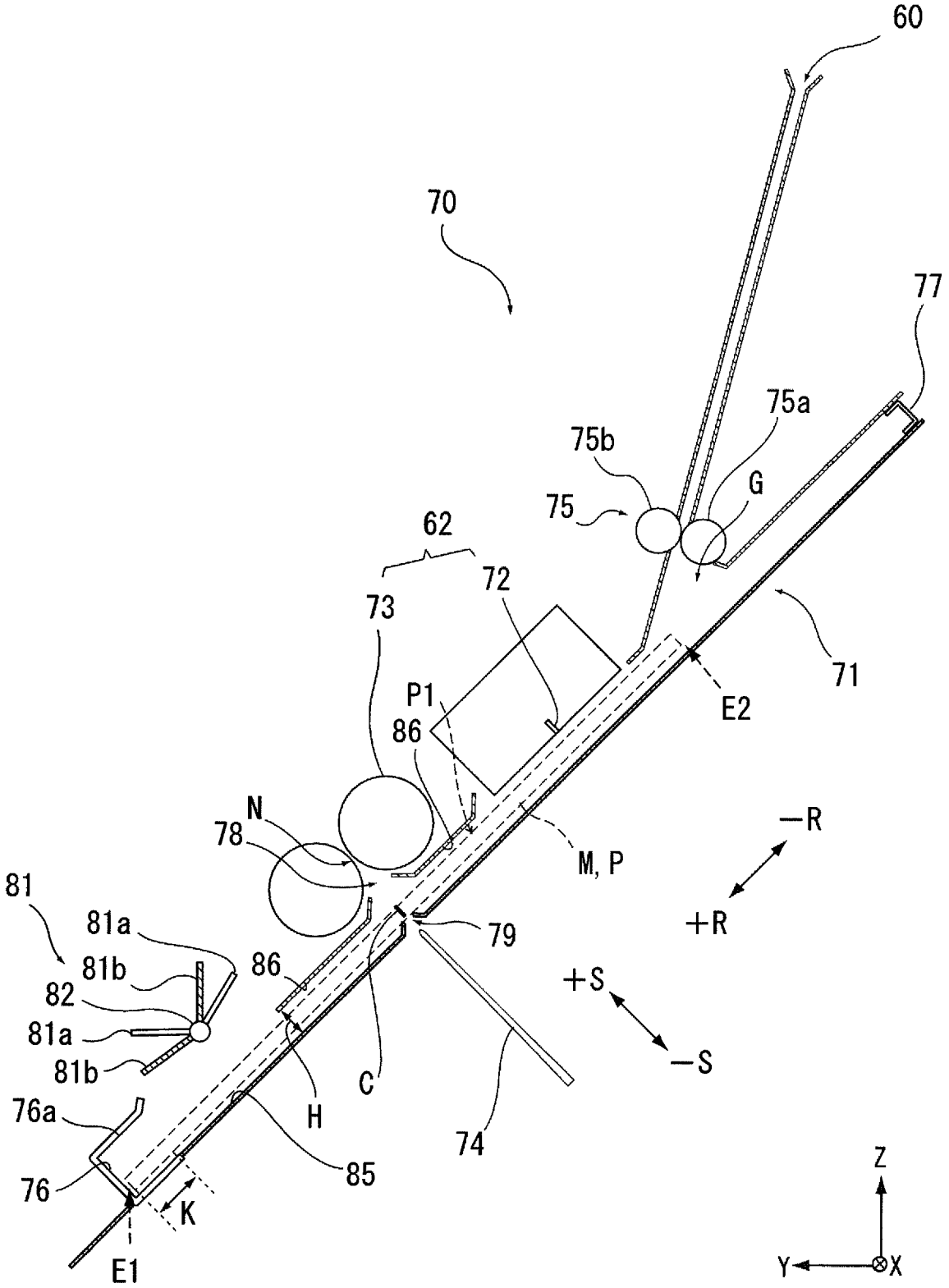
FIG. 3 is a cross-sectional view taken along the III-III arrow in FIG. 2.

The stack portion 71 is configured to be capable of changing a distance H between the support surface 85 and the opposing surface 86 illustrated in FIG. 3.

In this embodiment, a configuration in which the distance H between the support surface 85 and the opposing surface 86 is changed by displacing the opposing surface 86 in the +S direction or the −S direction with respect to the support surface 85 is adopted. In FIG. 3, the S-axis direction is an advancing and retreating direction in which the opposing surface 86 advances and retreats with respect to the support surface 85.

Figure 8:
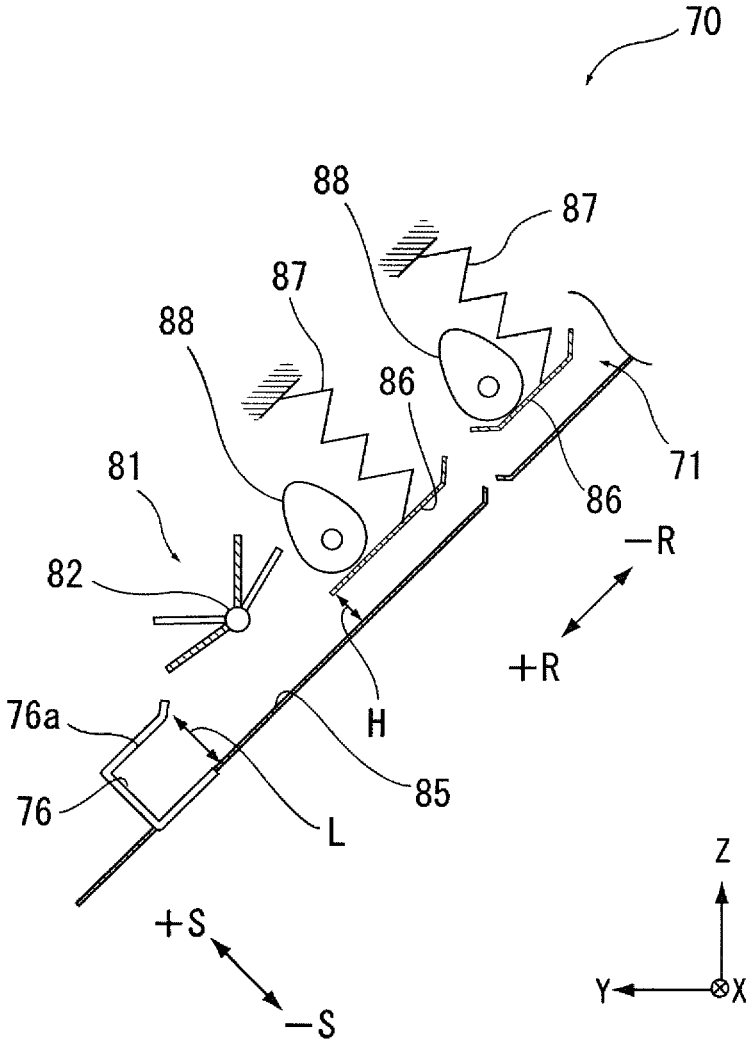
FIG. 8 is a schematic cross-sectional view illustrating main parts of the medium transport device.

The opposing surface 86 is pulled in the +S direction by a tension spring 87 as illustrated in FIG. 8 as an example. Then, the opposing surface 86 is configured to be displaced in the S-axis direction by rotating an eccentric cam 88 that is abutting on the opposing surface 86 and rotated by a drive source (not illustrated). The rotation of the eccentric cam 88 is controlled by the control unit 80 and accordingly, the distance H is controlled. The control unit 80 can detect the phase of the eccentric cam 88 by an encoder (not illustrated).

In this embodiment, the control unit 80 adjusts the distance H according to the condition. Adjustment of the distance H by the control unit 80 will be described in detail later with a specific condition.

The distance H can also be changed by advancing and retreating the support surface 85 with respect to the opposing surface 86. The distance H can also be changed by displacing both the support surface 85 and the opposing surface 86 in opposite directions in the S-axis direction.

As illustrated in FIG. 3, the second processing unit 62, which is a processing unit that performs processing on the medium P stacked in the stack portion 71 of the second unit 6 (medium processing apparatus), includes a binding unit 72 for binding the bundle of media M consisting of a plurality of media P stacked in the stack portion 71 at a binding position, and a folding roller pair of 73 as a folding unit for folding the bundle of media M at the binding position.

In FIG. 3, the reference numeral G indicates a joining position G where the transport path 60 and the stack portion 71 join. The binding position in this embodiment is the central portion C in the transport direction +R of the medium P stacked in the stack portion 71. The medium P is sent from the transport path 60 to the stack portion 71 by the feed roller pair 75.

In the stack portion 71, the alignment portion 76 capable of abutting on the downstream end E1 of the transport direction +R of the medium P stacked in the stack portion 71, and an abutment portion 77 capable of abutting on an upstream end E2 of the transport direction +R of the medium P stacked in the stack portion 71 are provided.

The alignment portion 76 and the abutment portion 77 are configured to be movable in both the transport direction +R of the medium P in the stack portion 71 and a reverse direction −R thereof illustrated in FIG. 3. The alignment portion 76 and the abutment portion 77 can be moved in the transport direction +R and the reverse direction −R, for example, using a rack and pinion mechanism, a belt moving mechanism, or the like operated by the power of a drive source (not illustrated). The alignment portion 76 is configured to be movable also in the S-axis direction which intersects the transport direction +R in FIG. 3. The movement of the alignment portion 76 will be described in detail when a stack operation in the stack portion 71 is described.

As illustrated in FIG. 3, the alignment portion 76 includes an eaves portion 76*a* facing a downstream end region K close to the downstream end E1 of the medium P stacked in the stack portion 71. The downstream end region K of the medium P may have any range as long as it is downstream of the central portion C in the transport direction +R of the medium P. In this embodiment, although the downstream end region K is a region including the alignment portion downstream end E1 and close to the downstream end E1, the downstream end region K may not necessarily include the downstream end E1.

A binding unit 72 for binding the bundle of media M stacked in the stack portion 71 at a predetermined position in the transport direction +R is provided downstream of the joining position G. The binding unit 72 is a stapler as an example. In this embodiment, as illustrated in FIG. 2, a plurality of binding units 72 are provided at intervals in the X-axis direction which is the width direction of the medium.

As described above, the binding unit 72 is configured to bind the bundle of media M with the central portion C of the bundle of media M as the binding position in the transport direction +R.

A folding roller pair 73 is provided downstream of the binding unit 72. The opposing surface 86 is open at a position corresponding to a nip position N of the folding roller pair 73, and an approach path 78 of the bundle of media M from the stack portion 71 to the folding roller pair 73 is formed. At the entrance of the approach path 78 of the opposing surface 86, slopes are formed which guide the central portion C, which is the binding position, from the stack portion 71 to the nip position N.

Figure 7:
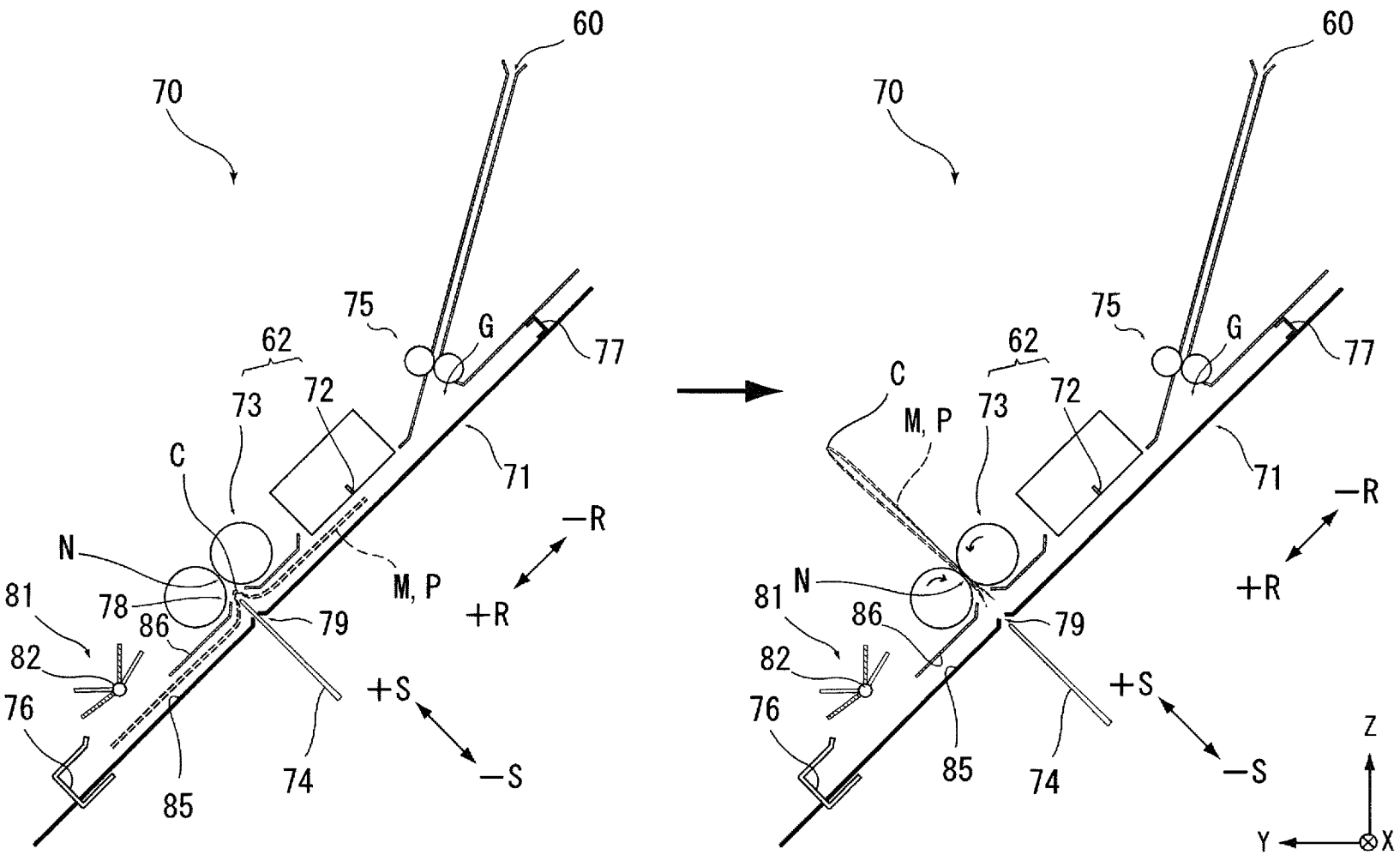
FIG. 7 is another diagram for explaining the flow of medium transport in the medium transport device.

A blade 74, which is capable of switching between a retreated state retreated from the stack portion 71 as illustrated in FIG. 3 and an advanced state advanced to the binding position of the bundle of media M stacked in the stack portion 71 as illustrated in the left diagram of FIG. 7, is provided on the opposite side of the folding roller pair 73 with the stack portion 71 interposed therebetween. Reference numeral 79 denotes a hole 79 provided in the support surface 85, and the blade 74 can pass through the hole 79.

About medium transport during saddle-stitching processing

Next, with reference to FIGS. 4 to 7, a basic flow from transporting the medium P to saddle stitching and discharging the medium P in the medium transport device 70 will be described.

Figure 4:
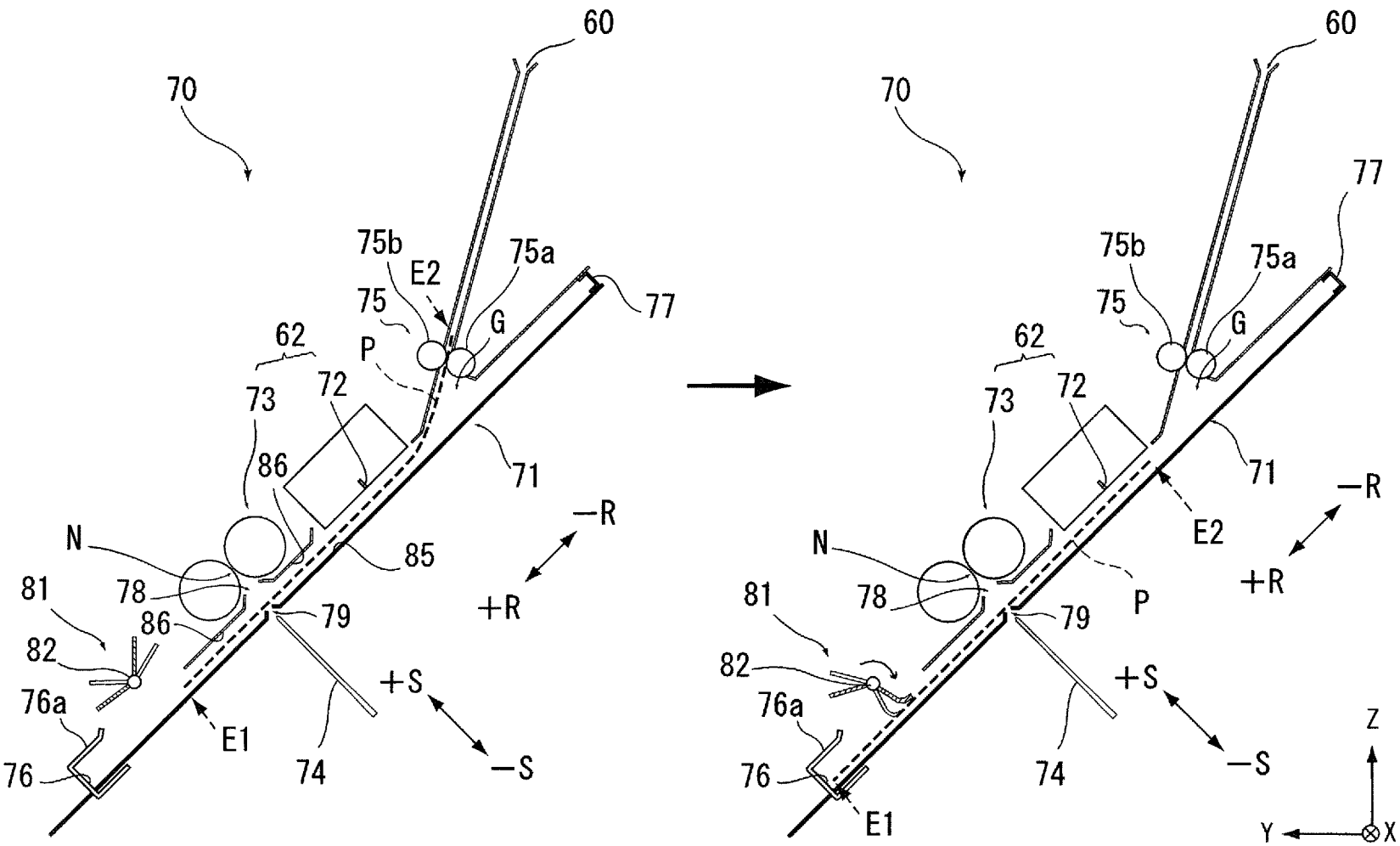
FIG. 4 is a diagram for explaining a flow of medium transport in the medium transport device.

First, as illustrated in the left diagram of FIG. 4, the medium P is transported from the transport path 60 toward the stack portion 71. The medium P is transported from the transport path 60 to the stack portion 71 by the feed roller pair 75. While the medium P is being sent to the stack portion 71 by the feed roller pair 75, the paddle 81 retreats from the stack portion 71.

As illustrated in the right diagram of FIG. 4, when the upstream end E2 of the medium P comes out of the nip of the feed roller pair 75, the medium P moves toward the alignment portion 76 by its own weight and the paddle 81 provided upstream of the alignment portion 76 is rotated to abut the medium P toward the alignment portion 76. The control unit 80 controls the operation of the paddle 81.

In the left diagram of FIG. 4, the alignment portion 76 is disposed such that the distance from the joining position G of the transport path 60 and the stack portion 71 to the alignment portion 76 is longer than the length of the medium P. With this configuration, as illustrated in the right diagram of FIG. 4, the medium P is received by the stack portion 71 without the upstream end E2 of the medium P transported from the transport path 60 remaining in the transport path 60. The position of the alignment portion 76 in the transport direction +R of the stack portion 71 can be changed according to a size of the medium P.

When the paddle 81 is rotated by a predetermined number of rotations so that the medium P abuts against the alignment portion 76, the paddle 81 is stopped in a state of being retreated from the stack portion 71. The alignment portion 76 is displaced in the −S direction as illustrated in the left diagram of FIG. 5 and the eaves portion 76*a* presses the medium P toward the support surface 85, and then, the alignment portion 76 is displaced in the +S direction to return to the original position, and prepares to receive the next medium P.

As illustrated in FIG. 8, when the alignment portion 76 is in a position capable of receiving the medium between the eaves portion 76*a* and the support surface 85, the distance L between the eaves portion 76*a* and the support surface 85 is longer than the distance H between the support surface 85 and the opposing surface 86. The distance L is a length by which the distance L > the distance H is maintained even if the distance H is changed. With this configuration, the medium P (not illustrated in FIG. 8) can be reliably guided between the eaves portion 76*a* and the support surface 85, and the downstream end E1 of the medium P can be brought into contact with the alignment portion 76.

Figure 5:
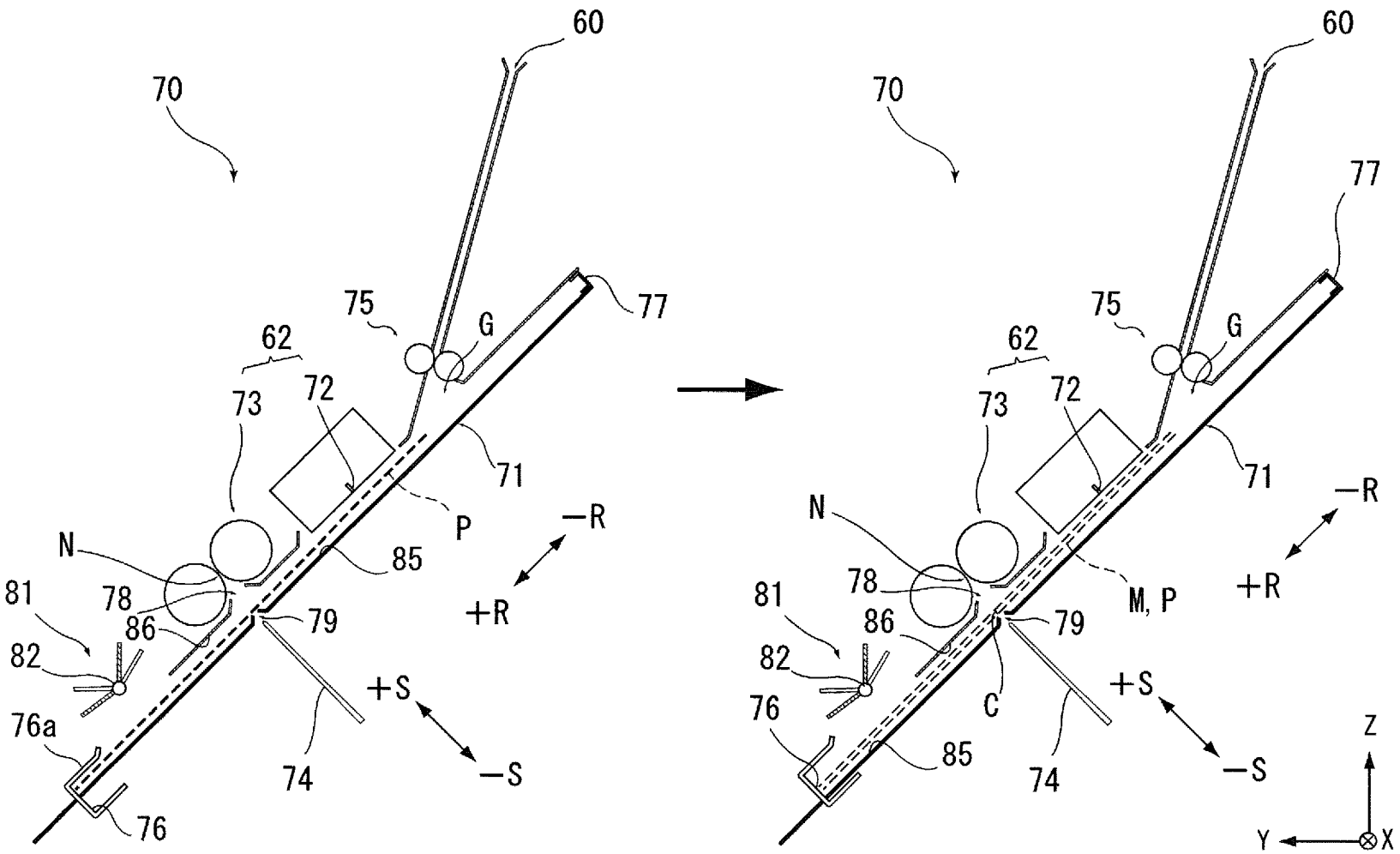
FIG. 5 is another diagram for explaining the flow of medium transport in the medium transport device.

The operations from the left diagram of FIG. 4 to the left diagram of FIG. 5 are repeated, and a plurality of media P are stacked in the stack portion 71 in a state where the downstream end E1 is aligned with the alignment portion 76. The right diagram of FIG. 5 illustrates a state in which the plurality of media P are stacked in the stack portion 71. A bundle of media P is referred to as a bundle of media M.

When a predetermined number of media P are stacked in the stack portion 71, the binding unit 72 performs binding processing in which the central portion C in the transport direction +R of the bundle of media M is bound. At the time when transport of the medium P from the transport path 60 to the stack portion 71 is completed, since the central portion C is shifted from the position of the binding unit 72 as illustrated in the right diagram of FIG. 5, the alignment portion 76 is moved in the −R direction and the central portion C of the bundle of media M is disposed at a position opposing the binding unit 72, as illustrated in the left diagram of FIG. 6. Furthermore, the abutment portion 77 is moved in the +R direction to abut on the upstream end E2 of the bundle of media M. The downstream end E1 and the upstream end E2 of the bundle of media M are aligned by the alignment portion 76 and the abutment portion 77, and the center portion C of the bundle of media M is bound by the binding unit 72.

Figure 6:
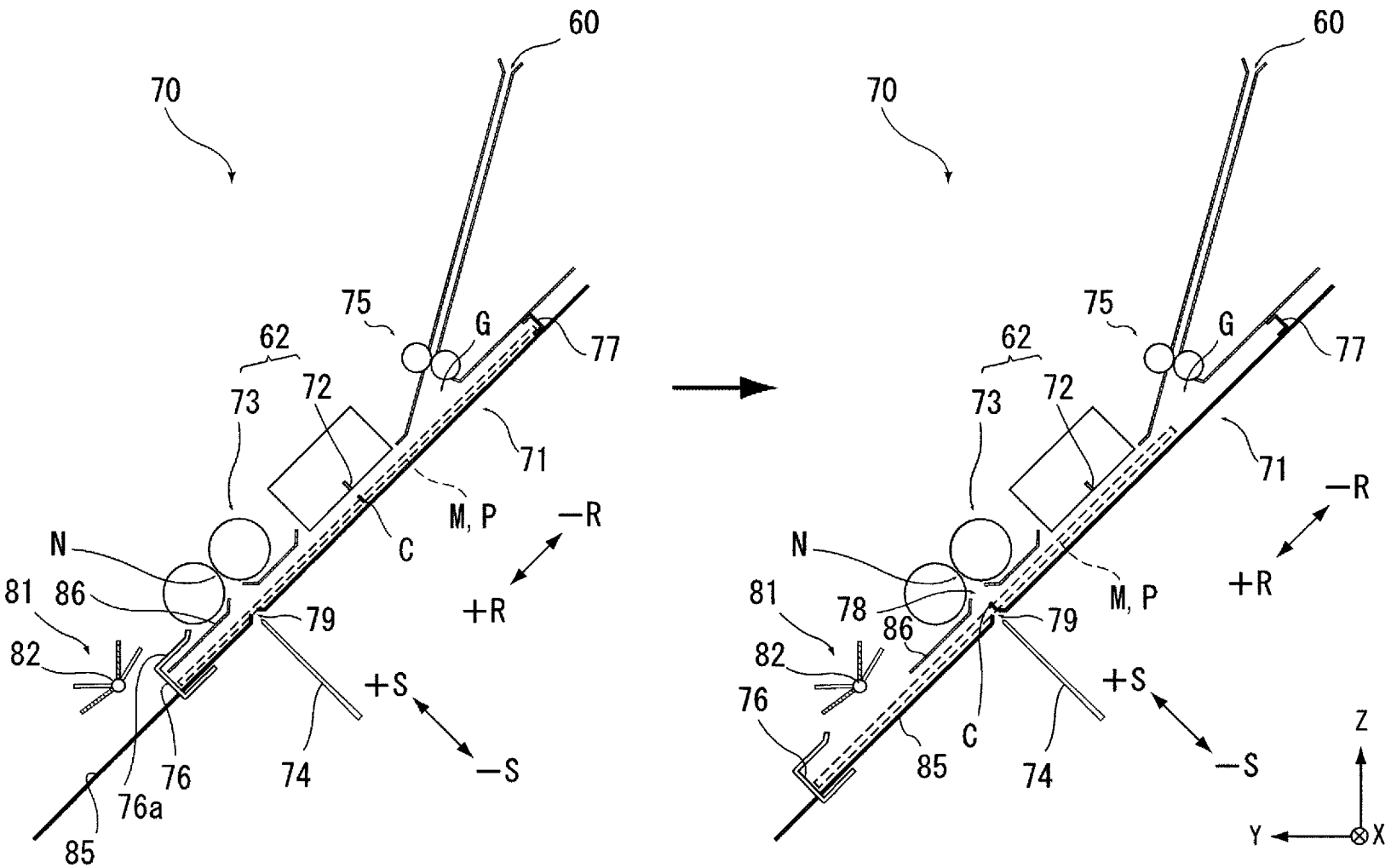
FIG. 6 is another diagram for explaining the flow of medium transport in the medium transport device.

When the bundle of media M is bound by the binding unit 72, the alignment portion 76 is moved in the +R direction as illustrated in the right diagram of FIG. 6, and the bundle of media M is moved such that the bound central portion C is disposed at a position opposing the nip position N of the folding roller pair 73. The bundle of media M can be moved in the +R direction by moving only the alignment portion 76 in the +R direction while maintaining a state in which the bundle of media M abuts on the alignment portion 76 by its own weight. The abutment portion 77 may be moved in the +R direction so as to maintain the state of being abutted on the upstream end E2 of the bundle of media M.

Subsequently, when the central portion C of the bundle of media M is disposed at a position opposing the nip position N of the folding roller pair 73, the blade 74 is advanced in the +S direction to bend the central portion C toward the folding roller pair 73 as illustrated in the left diagram of FIG. 7. The central portion C of the bent bundle of media M is moved toward the nip position N of the folding roller pair 73 through the approach path 78.

As illustrated in the right diagram of FIG. 7, when the central portion C of the bundle of media M is nipped by the folding roller pair 73, the folding roller pair 73 is rotated, and the bundle of media M is discharged toward the second tray 65 (FIG. 1) while being folded at the central portion C by the nip pressure of the folding roller pair 73.

After the central portion C is nipped by the folding roller pair 73, the alignment portion 76 moves in the +R direction, and returns to the state of the left diagram of FIG. 4 to prepare for the reception of the next medium P in the stack portion 71.

The transport path 60 can be provided with a crease forming mechanism that creases the central portion C of the medium P. By making a crease in the central portion C which is the folding position set by the folding roller pair 73, the bundle of media M can be easily folded at the central portion C.

About Control of Distance Between Support Surface and Opposing Surface by Control Unit Subsequently, control of the distance H (FIG. 3) between the support surface 85 and the opposing surface 86 by the control unit 80 will be described.

As described above, the control unit 80 adjusts the distance H according to the condition. As the conditions to be used by the control unit 80, conditions relating to the medium P at the time of stacking the medium P, for example, the number of stacked media P previously stacked in the stack portion 71, a discharge mount of ink discharged to the medium P at the time of recording in the recording unit 2, whether recording on the medium P is double-sided recording or single-sided recording, and environmental conditions such as temperature and humidity at the time of stacking the medium P are included, in addition to the type, rigidity, thickness, basis weight, and the like of the medium P.

When the distance H between the support surface 85 and the opposing surface 86 is constant, the medium P to be stacked may be subjected to a transport failure between the support surface 85 and the opposing surface 86.

In this embodiment, the control unit 80 adjusts the distance H according to the conditions, thereby capable of suppressing the transport failure of the medium P between the support surface 85 and the opposing surface 86 and appropriately stacking the medium P on the stack portion 71.

In this embodiment, although a configuration in which the distance H is controlled by the control unit 80 is adopted, for example, when a configuration in which entire control of the recording system 1 can be controlled by the first control unit 25 provided in the recording unit 2 is adopted, the control unit 25 can control the distance H by the first control unit 25.

Hereinafter, control of the distance H by the control unit 80 will be described by taking a specific example of the conditions.

Control According to One Condition

As the conditions to be used by the control unit 80, any of the type of medium P to be stacked, the number of stacked media previously stacked in the stack portion 71, the stack height of the medium P previously stacked in the stack portion 71, and the discharge amount of ink (liquid) to the medium P transported by the feed roller pair 75 can be used. In this embodiment, the medium P transported by the medium transport device 70 is a recorded medium to which ink is discharged for recording in the recording unit 2, and the discharge amount of ink is an amount of ink discharged to the medium P by the line head 20.

For example, the control unit 80 can adjust the distance H based on a table representing the relationship of the distance H according to the basis weight of the medium P as illustrated in Table 1 below.

TABLE 1

| Basis weight of medium (g/m$^2$) | Distance H |
|---|---|
| 60 or more, less than 70 | H1 |
| 70 or more, less than 80 | H2 |
| 80 or more, less than 90 | H3 |
| . | . |
| . | . |
| . | . |

In Table 1, H1<H2<H3. That is, as the basis weight of the medium P increases, the distance H is increased to widen the distance between the support surface 85 and the opposing surface 86.

As the basis weight increases, the frictional resistance when the medium P contacts the opposing surface 86 increases, and the medium P is difficult to move in the transport direction. Accordingly, by increasing the distance H as the basis weight of the medium P increases, the frictional resistance between the opposing surface 86 and the medium P to be stacked can be reduced, and the medium P can be reliably moved in the +R direction.

As illustrated in Table 1, the control unit 80 can be configured to change the distance H stepwise while keeping the distance H constant when the basis weight of the medium is in a predetermined range. The distance H may be continuously changed according to the basis weight.

The control unit 80 can adjust the distance H based on a table illustrating the relationship of the distance H according to the stack height of the medium P in the stack portion 71 as illustrated in Table 2 below.

TABLE 2

| Stack height (mm) | Distance H |
|---|---|
| less than 2 | H1 |
| 2 or more, less than 4 | H2 |
| 4 or more, less than 6 | H3 |
| . | . |
| . | . |
| . | . |

In Table 2, H1<H2<H3. That is, as the stack height of the medium P in the stack portion 71 increases, the distance H is increased to widen the interval between the support surface 85 and the opposing surface 86.

When the height of the stack increases and the space between the top medium P1 (FIG. 3) stacked in the stack portion 71 and the opposing surface 86 narrows, there is a possibility that the frictional resistance is likely to occur between the stack portion 71 and the subsequent medium sent to the stack portion 71, the subsequent medium is difficult to move toward the alignment portion 76, and the downstream end E1 does not reach the alignment portion 76 only by its own weight. In the state where the space between the top medium P1 and the opposing surface 86 is wide, the subsequent medium to be sent next to the stack portion 71 is easy to move downstream by its own weight.

By increasing the distance H with the stack height increases, the interval between the top medium P1 and the opposing surface 86 can be increased and the medium P can be reliably moved downstream.

As illustrated in Table 2, the control unit 80 can be configured to change the distance H stepwise while keeping the distance H constant when the stack height is within the predetermined range. The distance H may be changed continuously according to the stack height.

The number of stacked media stacked in the stack portion 71 corresponds to the height of the stack. Thus, a configuration in which the distance H can be increased to widen the distance between the support surface 85 and the opposing surface 86 as the number of stacked media in the stack portion 71 increases can be adopted.

When the discharge amount of ink (liquid) to the medium P transported by the feed roller pair 75 increases, the frictional resistance between the media increases, and thus the medium P is difficult to move toward the alignment portion 76 by its own weight. From this, with the increase of the discharge amount of ink (liquid) to the medium P, the distance H can be increased to widen the distance between the support surface 85 and the opposing surface 86.

The distance H can also be adjusted according to the difference in the thickness of the medium as the type of medium.

Since the medium is difficult to move toward the alignment portion 76 as the thickness of the medium P increases, a configuration in which the distance H is increased as the medium thickness is increased to widen the distance between the support surface 85 and the opposing surface 86 can be adopted.

As described above, the control unit 80 can adjust the distance H between the support surface 85 and the opposing surface 86 using any of the type of medium P to be stacked, the number of stacked media previously stacked in the stack portion 71, the stack height of the medium P previously stacked in the stack portion 71, and the discharge amount of ink (liquid) to the medium P transported by the feed roller pair 75, and transport the medium P downstream more appropriately.

Control According to a Plurality of Conditions

The control unit 80 can be configured to adjust the distance H between the support surface 85 and the opposing surface 86 using a plurality of conditions. The distance H can be adjusted more appropriately by using the plurality of conditions.

The plurality of conditions include two or more of the type of medium P to be stacked, temperature in an installation environment of the apparatus, humidity in the installation environment of the apparatus, the number of stacked media previously stacked in the stack portion 71, and the discharge amount of ink to the medium P.

For example, the control unit 80 uses, as the plurality of conditions, the type of medium and the number of stacked media previously stacked in the stack portion 71.

The control unit 80 has a threshold value T of the number of stacked media according to the type of the medium P as illustrated in Table 3 below, changes the threshold value T of the number of stacked media according to the type of the medium P, and adjusts the distance H between the support surface 85 and the opposing surface 86 according to a flowchart illustrated in FIG. 9.

TABLE 3

| Type of medium | Threshold value T |
|---|---|
| first paper type | T1 |
| second paper type | T2 |
| third paper type | T3 |
| . | . |
| . | . |
| . | . |

Figure 9:
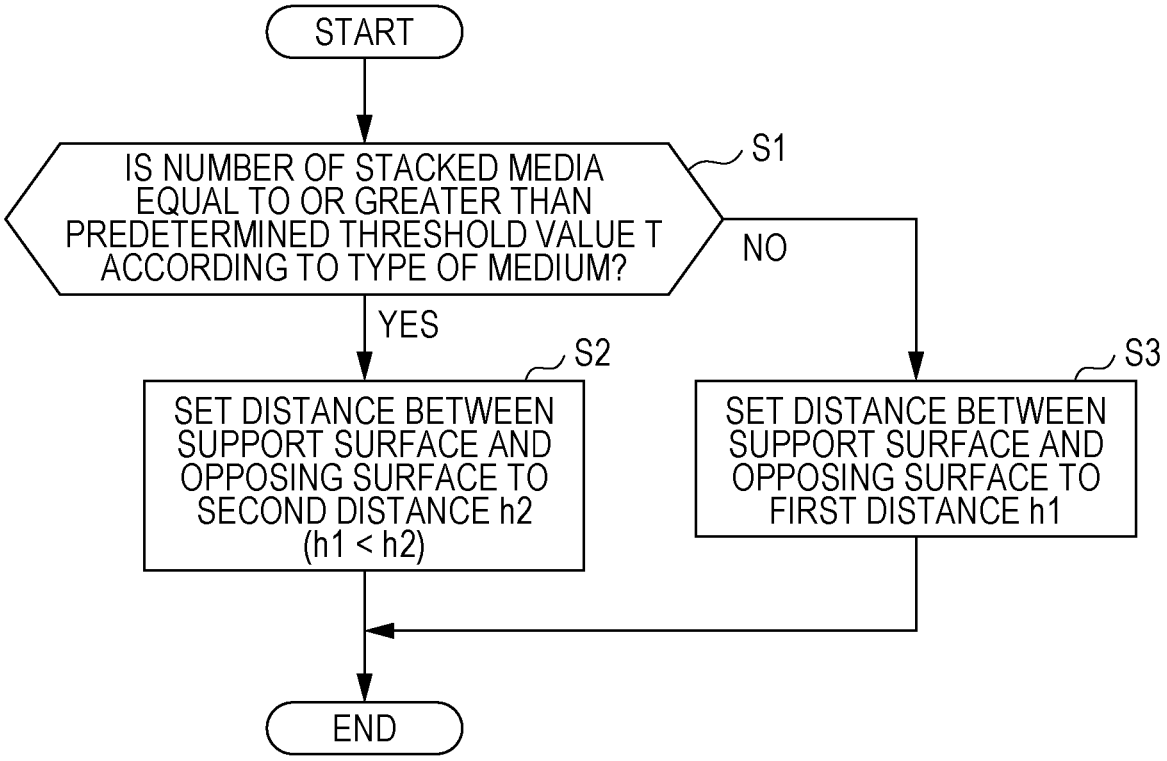
FIG. 9 is a flowchart illustrating a flow when controlling a distance between a support surface and an opposing surface using a type of medium and the number of stacked media in a stack portion as a condition.

In FIG. 9, in step S1, the control unit 80 determines whether the number of stacked media is equal to or greater than a predetermined threshold value T according to the type of medium P. For example, when the medium P to be stacked is a first sheet type, it is determined whether the number of stacked media is equal to or more than the threshold value T1.

When the determination result in step S1 is YES, that is, when it is determined that the number of stacked media is greater than or equal to the predetermined threshold value T according to the type of the medium P, the distance H is adjusted to a second distance h2 longer than a first distance h1 in stacking the medium P (Step S2). When the determination result in step S1 is NO, that is, when it is determined that the number of stacked media is less than the predetermined threshold value T according to the type of the medium P, the distance H is adjusted to the first distance h1 in stacking the medium P (step S3).

As described above, in the stack portion 71 in which the medium is stacked in the inclined posture in which the downstream side in the transport direction is directed downward, the stacked medium P is easy to move toward the alignment portion 76 by its own weight when the number of stacked media previously stacked in the stack portion is small and is difficult to move when the number of stacked media increases.

Here, the number of stacked media that makes it difficult for the medium P to move in the stack portion 71 changes according to the type of the medium P.

In this embodiment, as illustrated in the flowchart of FIG. 9, the control unit 80 adjusts the distance H between the support surface 85 and the opposing surface 86 using the threshold value T of the number of stacked media in consideration of the type of the medium P, and thus the medium P can be more reliably moved downstream and aligned with the alignment portion 76.

The control unit 80 can use the discharge amount of ink to the medium P and the number of stacked media in the stack portion 71 as the plurality of conditions.

The control unit 80 has a predetermined threshold value according to the discharge amount of ink to the medium P as illustrated in Table 4 below, changes the predetermined threshold value t according to the discharge amount of ink to the medium P, and adjusts the distance H between the support surface 85 and the opposing surface 86 according to a flowchart illustrated in FIG. 10.

In the following, recording density (%) is used as a value corresponding to the discharge amount of ink to the medium P. The recording density (%) is a value that increases or decreases according to the ink discharge amount, and is a ratio of the total ink discharge amount (g) to the maximum ink ejection amount (g) to a recordable region of one sheet of paper. That is, recording density (%)=total ink discharge amount (g) to one sheet of paper/maximum ink ejection amount (g)×100. The maximum ink ejection amount (g) to the recordable region of one sheet of paper can be obtained from the maximum ink ejection amount (g) per unit area by the line head 20 provided in the recording unit 2.

The present disclosure is not limited to this, and the recording density (%) can also be a ratio of an area of the region where ink is discharged to the area of one sheet of paper.

TABLE 4

| Recording density (%) (discharge amount of ink to medium) | Threshold value t |
|---|---|
| 0 or more, less than 10 | t1 |
| 10 or more, less than 20 | t2 |
| 20 or more, less than 30 | t3 |
| . | . |
| . | . |
| . | . |

Figure 10:
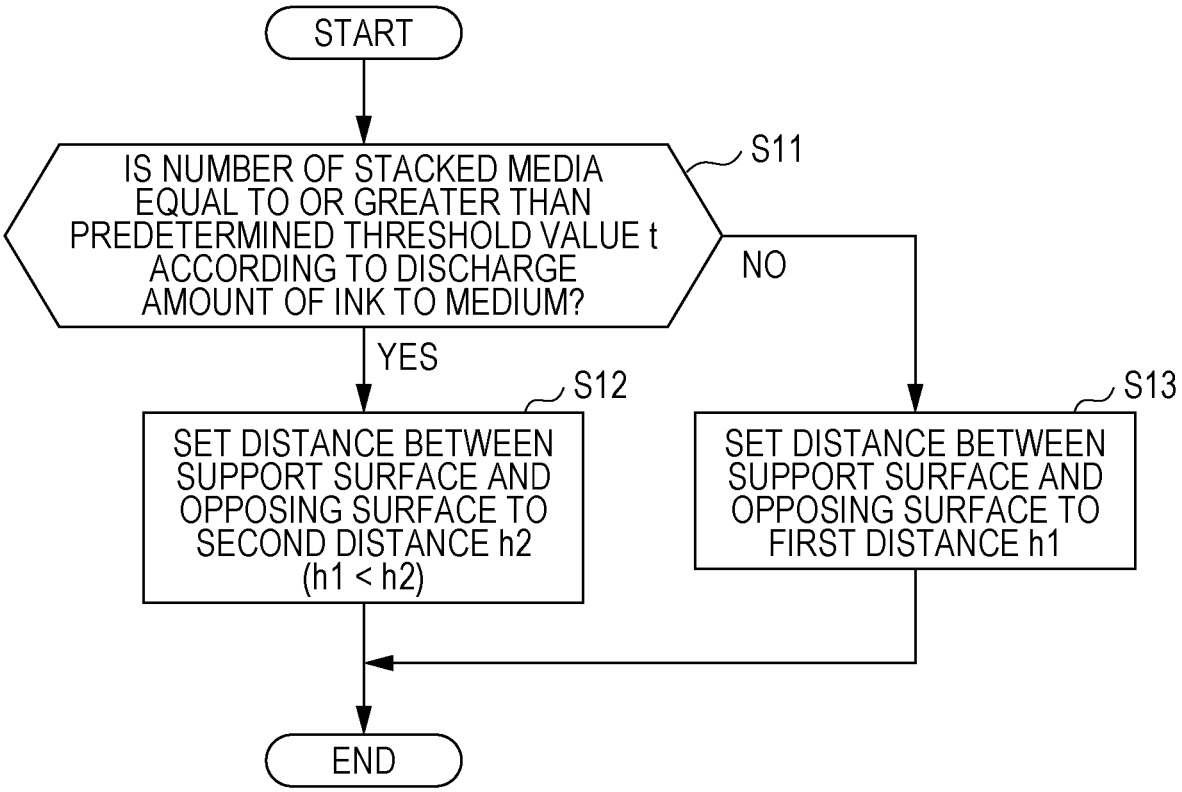
FIG. 10 is a flowchart illustrating a flow when controlling the distance between the support surface and the opposing surface using a discharge amount of ink to the medium and the number of stacked media in the stack portion as the condition.

In FIG. 10, in step S11, the control unit 80 determines whether the number of stacked media is equal to or greater than the predetermined threshold value t according to the recording density of the medium P (discharge amount of ink to the medium P). For example, when the recording density on the stacked medium P is 0% or more and less than 10%, it is determined whether or not the number of stacked media is equal to or greater than a threshold value t1.

When the determination result in step S11 is YES, that is, when it is determined that the number of stacked media is greater than or equal to the predetermined threshold value t according to the recording density of the medium P, the distance H is adjusted to the second distance h2 longer than the first distance h1 in stacking the medium P (Step S12). When the determination result in step S11 is NO, that is, when it is determined that the number of stacked media is less than the predetermined threshold value t according to the recording density of the medium P, the distance H is adjusted to the first distance h1 in stacking the medium P (step S13).

Although the medium P stacked in the stack portion 71 is easy to move toward the alignment portion 76 by its own weight when the number of stacked media previously stacked in the stack portion is small and is difficult to move when the number of stacked media increases, the number of stacked media that makes it difficult for the medium P to move by its own weight changes according to the frictional resistance between the media. The frictional resistance between the media changes according to the discharge amount of ink to the medium P. When the discharge amount of ink to the medium P is large, that is, the recording density is high, the frictional resistance between the media tends to be large, and when the discharge amount of ink to the medium P is small, that is, the recording density is low, the frictional resistance between the media tends to be small.

In this embodiment, as illustrated in the flowchart of FIG. 10, the control unit 80 adjusts the distance H between the support surface 85 and the opposing surface 86 using the threshold value t of the number of stacked media in consideration of the discharge amount of ink to the medium P, and thus the medium P can be more reliably moved downstream and aligned with the alignment portion 76.

The threshold value t of the number of stacked media according to the discharge amount of ink to the medium P is set lower as the discharge amount of ink to the medium P increases. That is, in Table 4, t1>t2>t3.

Since the frictional resistance between the media increases as the discharge amount of the ink to the medium P increases, even if the number of stacked media in the stack portion 71 is small, the medium P with a large discharge amount of ink to the medium P is difficult to move toward the alignment portion by its own weight. Since the threshold value t is set lower as the discharge amount of ink to the medium P increases, the possibility of the transport failure of the medium P in the stack portion 71 can be suppressed more reliably.

As illustrated in Table 4, when there are a plurality of relationships between the ink discharge amount and the threshold value t, it is sufficient to include at least one relationship in which the threshold value decreases when the ink discharge amount increases. That is, for example, when t1>t2, t2=t3 may be satisfied.

When the medium P to be stacked is in a state of being susceptible to curling, the threshold value t of the number of stacked media according to the ink discharge amount may be set to a low value. For example, if there is a difference between the discharge amount of ink to the first surface and the opposite second surface of the medium, the medium tends to curl. Accordingly, when there is a difference between the discharge amount of ink to the first surface and the second surface of the medium, the threshold value t may be set low.

Next, description will be made on control of the distance H between the support surface 85 and the opposing surface 86, which is performed by the control unit 80 using the type of medium, the temperature and humidity in the installation environment of the apparatus, the discharge amount of ink to the medium P, and the number of stacked media in the stack portion 71, as the plurality of conditions.

For each of a first paper type, a second paper type, and a third paper type having different basis weights as media types, the control unit 80 includes three control tables (first to third tables) according to the discharge amount of ink (recording density), temperature in a dry environment, humidity in a dry environment, and the number of stacked media in the stack portion 71. The basis weights of the first paper type, the second paper type, and the third paper type are, for example, 60 g/m$^2$ or more and less than 80 g/m$^2$ for the first paper type, 80 g/m$^2$ or more and less than 100 g/m$^2$, for the second paper type, and 100 g/m$^2$ or more for the third paper type.

Figure 11:
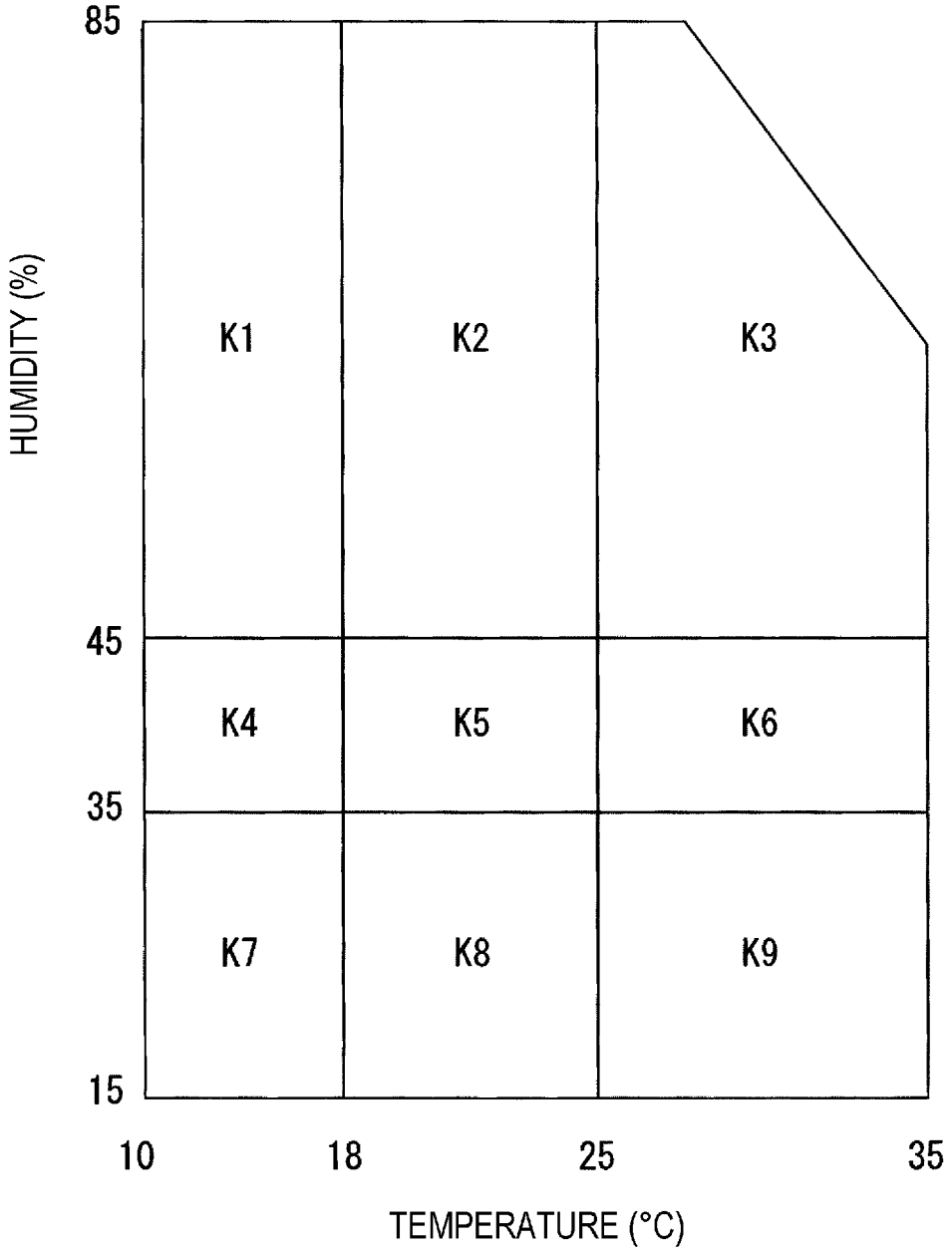
FIG. 11 is a graph illustrating classifications according to a relationship between temperature and humidity in an installation environment of an apparatus.

As the temperature and humidity of the installation environment of the apparatus, the temperature and humidity of the room where the recording system 1 is installed can be used. A humidity measurement unit and a temperature measurement unit (not illustrated) may be provided in the recording unit 2 and the measurement results of the measurement units may be used. Although either one of temperature and humidity may be used, in this embodiment, the installation environment of the apparatus is divided into nine sections K1 to K9 as illustrated in FIG. 11 according to the relationship between temperature and humidity in a temperature and humidity environment.

In Table 5, an example of a first table which is a control table for the first paper type is illustrated. In Table 6, an example of a second table which is a control table for the second paper type is illustrated. In Table 7, an example of a third table which is a control table for the third paper type is illustrated.

The first table (Table 5), the second table (Table 6), and the third table (Table 7) respectively represents threshold values for the number of stacked media, which are determined according to classification of the installation environment of the apparatus and the discharge amount of ink (recording density), and the distance H between the support surface 85 and the opposing surface 86, which is adjusted when the number of stacked media is equal to or greater than the threshold value.

In the first table (Table 5), the second table (Table 6), and the third table (Table 7), the distance H between the support surface 85 and the opposing surface 86 is divided into, for example, three steps of distances which satisfy a relationship of first distance<second distance<third distance. Of course, the distance can be further divided and controlled.

TABLE 5

First table

| | Environment | | | | | |
|---|---|---|---|---|---|---|
| | Classification K1 | | Classification K2 | | Classification K3 | |
| Recording density (%) | Threshold value for the number of stacked media | Distance between support surface and opposing surface | Threshold value for the number of stacked media | Distance between support surface and opposing surface | Threshold value for the number of stacked media | Distance between support surface and opposing surface |
| 0 or more, less than 10 | 20 secs | third distance | 18 | third distance | 16 | third distance |
| 10 or more, less than 20 | 18 | third distance | 16 | third distance | 14 | third distance |
| 20 or more, less than 30 | 16 | third distance | 14 | second distance | 12 | second distance |
| 30 or more, less than 40 | 14 | second distance | 12 | second distance | 10 | second distance |
| 40 or more, less than 50 | 12 | second distance | 10 | second distance | 5 | second distance |
| 50 or more, less than 60 | 10 | second distance | 5 | first distance | 0 | first distance |
| 60 or more, less than 70 | 5 | first distance | 0 | first distance | 0 | first distance |
| 70 or more, less than 80 | 0 | first distance | 0 | first distance | 0 | first distance |
| 80 or more, less than 90 | 0 | first distance | 0 | first distance | 0 | first distance |
| 90 or more, less than 100 | 0 | first distance | 0 | first distance | 0 | first distance |
| 100 or more | 0 | first distance | 0 | first distance | 0 | first distance |

TABLE 5-continued

First table

| Recording density (%) | Environment | | | | | |
|---|---|---|---|---|---|---|
| | Classification K4 | | Classification K5 | | Classification K6 | |
| | Threshold value for the number of stacked media | Distance between support surface and opposing surface | Threshold value for the number of stacked media | Distance between support surface and opposing surface | Threshold value for the number of stacked media | Distance between support surface and opposing surface |
| 0 or more, less than 10 | 20 secs | third distance | 20 secs | third distance | 20 secs | third distance |
| 10 or more, less than 20 | 20 secs | third distance | 20 secs | third distance | 20 secs | third distance |
| 20 or more, less than 30 | 18 | third distance | 20 secs | third distance | 20 secs | third distance |
| 30 or more, less than 40 | 16 | third distance | 18 | third distance | 20 secs | third distance |
| 40 or more, less than 50 | 14 | second distance | 16 | third distance | 18 | third distance |
| 50 or more, less than 60 | 12 | second distance | 14 | second distance | 16 | third distance |
| 60 or more, less than 70 | 10 | second distance | 12 | second distance | 14 | second distance |
| 70 or more, less than 80 | 5 | first distance | 10 | second distance | 12 | second distance |
| 80 or more, less than 90 | 0 | first distance | 5 | first distance | 10 | second distance |
| 90 or more, less than 100 | 0 | first distance | 0 | first distance | 5 | first distance |
| 100 or more | 0 | first distance | 0 | first distance | 0 | first distance |

| Recording density (%) | Environment | | | | | |
|---|---|---|---|---|---|---|
| | Classification K7 | | Classification K8 | | Classification K9 | |
| | Threshold value for the number of stacked media | Distance between support surface and opposing surface | Threshold value for the number of stacked media | Distance between support surface and opposing surface | Threshold value for the number of stacked media | Distance between support surface and opposing surface |
| 0 or more, less than 10 | 20 secs | third distance | 20 secs | third distance | 20 secs | third distance |
| 10 or more, less than 20 | 20 secs | third distance | 20 secs | third distance | 20 secs | third distance |
| 20 or more, less than 30 | 20 secs | third distance | 20 secs | third distance | 20 secs | third distance |
| 30 or more, less than 40 | 20 secs | third distance | 20 secs | third distance | 20 secs | third distance |
| 40 or more, less than 50 | 18 | third distance | 18 | third distance | 18 | third distance |
| 50 or more, less than 60 | 16 | third distance | 16 | third distance | 16 | third distance |
| 60 or more, less than 70 | 14 | second distance | 14 | third distance | 14 | third distance |
| 70 or more, less than 80 | 12 | second distance | 12 | second distance | 12 | third distance |
| 80 or more, less than 90 | 10 | second distance | 10 | second distance | 10 | second distance |
| 90 or more, less than 100 | 5 | first distance | 5 | second distance | 5 | second distance |
| 100 or more | 0 | first distance | 0 | first distance | 0 | second distance |

TABLE 6

Second table

| Recording density (%) | Environment | | | | | |
|---|---|---|---|---|---|---|
| | Classification K1 | | Classification K2 | | Classification K3 | |
| | Threshold value for the number of stacked media | Distance between support surface and opposing surface | Threshold value for the number of stacked media | Distance between support surface and opposing surface | Threshold value for the number of stacked media | Distance between support surface and opposing surface |
| 0 or more, less than 10 | 18 | third distance | 16 | third distance | 14 | third distance |
| 10 or more, less than 20 | 16 | third distance | 14 | third distance | 12 | third distance |
| 20 or more, less than 30 | 14 | second distance | 12 | third distance | 10 | third distance |
| 30 or more, less than 40 | 12 | second distance | 10 | second distance | 5 | third distance |
| 40 or more, less than 50 | 10 | second distance | 5 | second distance | 0 | second distance |
| 50 or more, less than 60 | 5 | first distance | 0 | second distance | 0 | second distance |
| 60 or more, less than 70 | 0 | first distance | 0 | first distance | 0 | second distance |
| 70 or more, less than 80 | 0 | first distance | 0 | first distance | 0 | first distance |
| 80 or more, less than 90 | 0 | first distance | 0 | first distance | 0 | first distance |
| 90 or more, less than 100 | 0 | first distance | 0 | first distance | 0 | first distance |
| 100 or more | 0 | first distance | 0 | first distance | 0 | first distance |

TABLE 6-continued

Second table

| Recording density (%) | Environment | | | | | |
|---|---|---|---|---|---|---|
| | Classification K4 | | Classification K5 | | Classification K6 | |
| | Threshold value for the number of stacked media | Distance between support surface and opposing surface | Threshold value for the number of stacked media | Distance between support surface and opposing surface | Threshold value for the number of stacked media | Distance between support surface and opposing surface |
| 0 or more, less than 10 | 20 secs | third distance | 20 secs | third distance | 20 secs | third distance |
| 10 or more, less than 20 | 18 | third distance | 20 secs | third distance | 20 secs | third distance |
| 20 or more, less than 30 | 16 | third distance | 18 | third distance | 20 secs | third distance |
| 30 or more, less than 40 | 14 | second distance | 16 | third distance | 18 | third distance |
| 40 or more, less than 50 | 12 | second distance | 14 | second distance | 16 | third distance |
| 50 or more, less than 60 | 10 | second distance | 12 | second distance | 14 | second distance |
| 60 or more, less than 70 | 5 | first distance | 10 | second distance | 12 | second distance |
| 70 or more, less than 80 | 0 | first distance | 5 | first distance | 10 | second distance |
| 80 or more, less than 90 | 0 | first distance | 0 | first distance | 5 | first distance |
| 90 or more, less than 100 | 0 | first distance | 0 | first distance | 0 | first distance |
| 100 or more | 0 | first distance | 0 | first distance | 0 | first distance |

| Recording density (%) | Environment | | | | | |
|---|---|---|---|---|---|---|
| | Classification K7 | | Classification K8 | | Classification K9 | |
| | Threshold value for the number of stacked media | Distance between support surface and opposing surface | Threshold value for the number of stacked media | Distance between support surface and opposing surface | Threshold value for the number of stacked media | Distance between support surface and opposing surface |
| 0 or more, less than 10 | 20 secs | third distance | 20 secs | third distance | 20 secs | third distance |
| 10 or more, less than 20 | 20 secs | third distance | 20 secs | third distance | 20 secs | third distance |
| 20 or more, less than 30 | 20 secs | third distance | 20 secs | third distance | 20 secs | third distance |
| 30 or more, less than 40 | 18 | third distance | 20 secs | third distance | 20 secs | third distance |
| 40 or more, less than 50 | 16 | second distance | 18 | third distance | 18 | third distance |
| 50 or more, less than 60 | 14 | second distance | 16 | second distance | 16 | third distance |
| 60 or more, less than 70 | 12 | second distance | 14 | second distance | 14 | second distance |
| 70 or more, less than 80 | 10 | first distance | 12 | second distance | 12 | second distance |
| 80 or more, less than 90 | 5 | first distance | 10 | first distance | 10 | second distance |
| 90 or more, less than 100 | 0 | first distance | 5 | first distance | 5 | first distance |
| 100 or more | 0 | first distance | 0 | first distance | 0 | first distance |

TABLE 7

Third table

| Recording density (%) | Environment | | | | | |
|---|---|---|---|---|---|---|
| | Classification K1 | | Classification K2 | | Classification K3 | |
| | Threshold value for the number of stacked media | Distance between support surface and opposing surface | Threshold value for the number of stacked media | Distance between support surface and opposing surface | Threshold value for the number of stacked media | Distance between support surface and opposing surface |
| 0 or more, less than 10 | 20 secs | third distance | 20 secs | third distance | 20 secs | third distance |
| 10 or more, less than 20 | 20 secs | second distance | 20 secs | third distance | 20 secs | third distance |
| 20 or more, less than 30 | 18 | second distance | 20 secs | second distance | 18 | third distance |
| 30 or more, less than 40 | 16 | second distance | 18 | second distance | 16 | second distance |
| 40 or more, less than 50 | 14 | first distance | 16 | second distance | 14 | second distance |
| 50 or more, less than 60 | 12 | first distance | 14 | first distance | 12 | second distance |
| 60 or more, less than 70 | 10 | first distance | 12 | first distance | 10 | first distance |
| 70 or more, less than 80 | 5 | first distance | 10 | first distance | 5 | first distance |
| 80 or more, less than 90 | 0 | first distance | 5 | first distance | 0 | first distance |
| 90 or more, less than 100 | 0 | first distance | 0 | first distance | 0 | first distance |
| 100 or more | 0 | first distance | 0 | first distance | 0 | first distance |

TABLE 7-continued

Third table

| Recording density (%) | Environment | | | | | |
|---|---|---|---|---|---|---|
| | Classification K4 | | Classification K5 | | Classification K6 | |
| | Threshold value for the number of stacked media | Distance between support surface and opposing surface | Threshold value for the number of stacked media | Distance between support surface and opposing surface | Threshold value for the number of stacked media | Distance between support surface and opposing surface |
| 0 or more, less than 10 | 20 secs | third distance | 20 secs | third distance | 20 secs | third distance |
| 10 or more, less than 20 | 20 secs | third distance | 20 secs | third distance | 20 secs | third distance |
| 20 or more, less than 30 | 20 secs | third distance | 20 secs | third distance | 20 secs | third distance |
| 30 or more, less than 40 | 18 | second distance | 18 | third distance | 18 | third distance |
| 40 or more, less than 50 | 16 | second distance | 16 | second distance | 16 | third distance |
| 50 or more, less than 60 | 14 | second distance | 14 | second distance | 14 | second distance |
| 60 or more, less than 70 | 12 | first distance | 12 | second distance | 12 | second distance |
| 70 or more, less than 80 | 10 | first distance | 10 | first distance | 10 | second distance |
| 80 or more, less than 90 | 5 | first distance | 5 | first distance | 5 | first distance |
| 90 or more, less than 100 | 0 | first distance | 0 | first distance | 0 | first distance |
| 100 or more | 0 | first distance | 0 | first distance | 0 | first distance |

| Recording density (%) | Environment | | | | | |
|---|---|---|---|---|---|---|
| | Classification K7 | | Classification K8 | | Classification K9 | |
| | Threshold value for the number of stacked media | Distance between support surface and opposing surface | Threshold value for the number of stacked media | Distance between support surface and opposing surface | Threshold value for the number of stacked media | Distance between support surface and opposing surface |
| 0 or more, less than 10 | 20 secs | third distance | 20 secs | third distance | 20 secs | third distance |
| 10 or more, less than 20 | 20 secs | third distance | 20 secs | third distance | 20 secs | third distance |
| 20 or more, less than 30 | 20 secs | third distance | 20 secs | third distance | 20 secs | third distance |
| 30 or more, less than 40 | 18 | third distance | 18 | third distance | 18 | third distance |
| 40 or more, less than 50 | 16 | second distance | 16 | third distance | 16 | third distance |
| 50 or more, less than 60 | 14 | second distance | 14 | second distance | 14 | third distance |
| 60 or more, less than 70 | 12 | second distance | 12 | second distance | 12 | second distance |
| 70 or more, less than 80 | 10 | first distance | 10 | second distance | 10 | second distance |
| 80 or more, less than 90 | 5 | first distance | 5 | first distance | 5 | second distance |
| 90 or more, less than 100 | 0 | first distance | 0 | first distance | 0 | first distance |
| 100 or more | 0 | first distance | 0 | first distance | 0 | first distance |

Figure 12:
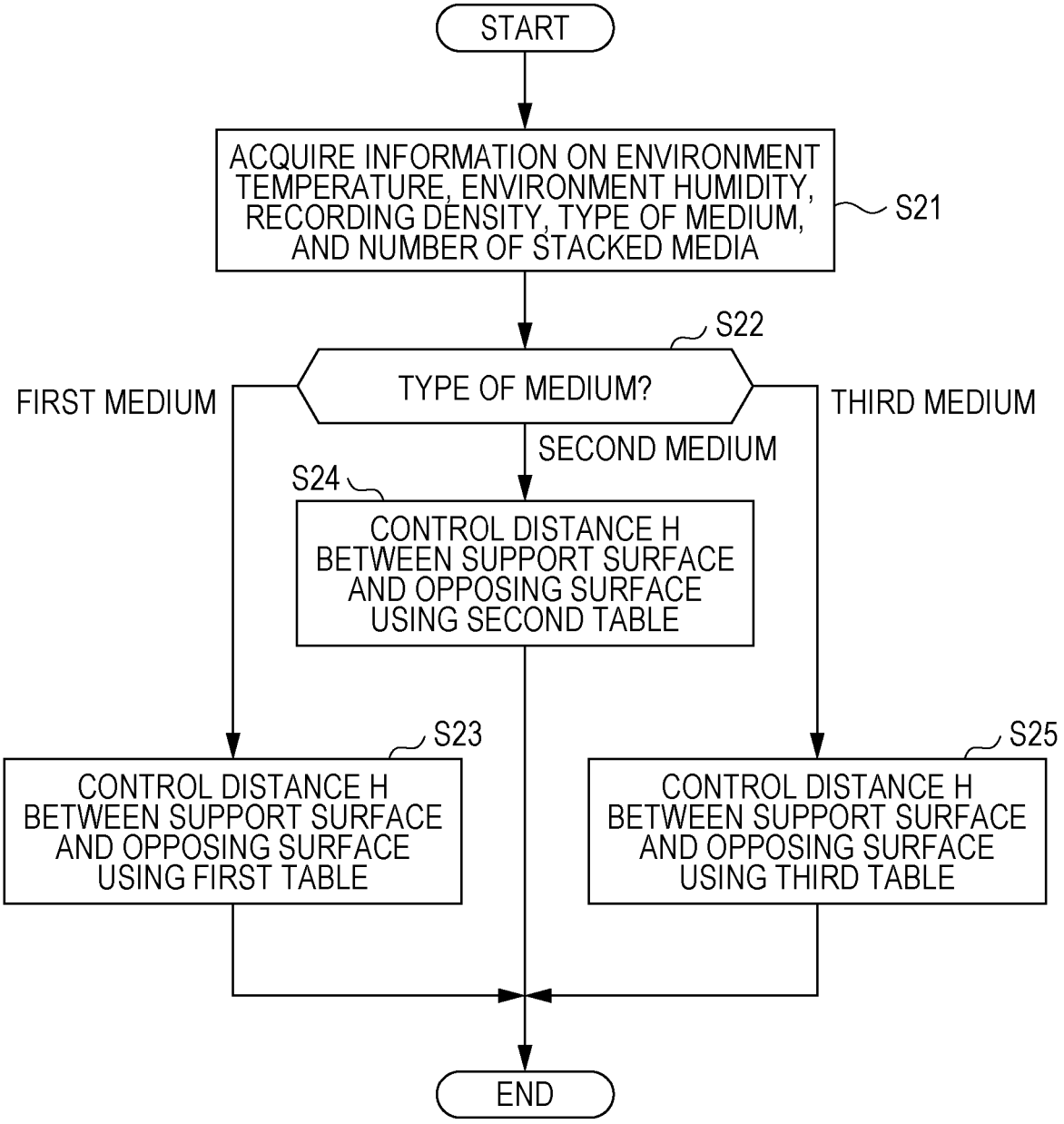
FIG. 12 is a flowchart illustrating a flow when controlling the distance between the support surface and the opposing surface using temperature and humidity in an installation environment of the apparatus, the type of medium, the discharge amount of ink to the medium, and the number of stacked media in the stack portion as the condition.

The control unit 80 controls the distance H between the support surface 85 and the opposing surface 86 according to a flowchart illustrated in FIG. 12. In step S21, the control unit 80 acquires information on the temperature and humidity in the installation environment of the apparatus, the recording density, the number of stacked media in the stack portion 71, and the type of medium.

Subsequently, the process proceeds to step S22, it is determined whether the type of medium is a first medium, a second medium, or a third medium. When it is determined, in step S22, that the type of medium is the first medium, the process proceeds to step S23 and the distance H is controlled using the first table (Table 5). When it is determined, in step S22, that the type of medium is the second medium, the process proceeds to step S24 and the distance H is controlled using the second table (Table 6). When it is determined, in step S22, that the type of medium is the third medium, the process proceeds to step S25 and the distance H is controlled using the third table (Table 7).

As described above, the control unit 80 uses, as the conditions, the type of medium, the temperature and humidity in the installation environment of the apparatus, the discharge amount of ink to the medium P, and the number of stacked media in the stack portion 71 and controls the distance H based on the plurality of conditions, thereby capable of suppressing the transport failure of the medium between the support surface 85 and the opposing surface 86. Thus, the medium P can be moved toward the alignment portion 76 more appropriately.

About Paddle

In this embodiment, the paddle 81 is configured to be displaceable in the S-axis direction, which is the advancing and retreating direction of the opposing surface 86. Then, when the opposing surface 86 is displaced, the paddle 81 is displaced in the same direction as a displacement direction of the opposing surface 86.

When the number of stacked media in the stack portion 71 increases, the paddle 81 is pressed more strongly to the medium P than when the number of stacked media is small, and thus a moving force applied to the medium P by the paddle 81 may change. There is a possibility that marks or scratches are caused by the paddle 81 on the medium P.

For example, when the number of stacked media on the stack portion 71 is increased by displacing the paddle 81 in the same direction as the displacement direction of the opposing surface 86, since the paddle 81 is also moved in the +S direction when the opposing surface 86 is moved in the direction to increase the distance H, that is, in the +S direction, it is possible to reduce change in a contact state of the paddle 81 with the medium P due to the increase in the number of stacked media. Thus, the paddle 81 can be brought into contact with the medium P more appropriately.

As illustrated in FIG. 2, the paddle 81 is provided with a first paddle 81*a* and a second paddle 81*b* which are provided at intervals in the width direction (X-axis direction) intersecting the transport direction (+R direction). In this embodiment, two first paddles 81*a* are provided at intervals in the center in the width direction, and two second paddles 81*b* are provided on both sides of the first paddles.

The first paddle 81*a* and the second paddle 81*b* are disposed such that the phases in the circumferential direction of the rotation shaft 82 are different from each other as illustrated in FIG. 3.

Although the paddle 81 sends the medium P in the transport direction +R by rotating while being in contact with the medium P, a contact angle of the rotating paddle 81 with respect to the medium P changes, and thus a wave (velocity unevenness) may be generated in the transport speed of the medium P.

In this embodiment, since two types of paddles (first paddle 81*a* and second paddle 81*b*) whose phases in the circumferential direction of the rotation shaft 82 are different from each other are provided, the wave of the transport speed of the medium P generated by the first paddle 81*a* and the wave of the transport speed generated by the second paddle 81*b* are offset. Accordingly, the transport speed of the medium P can be made uniform as a whole.

For example, the first paddle 81*a* and the second paddle 81*b* may be configured such that one first paddle 81*a* is provided at the center in the width direction and the second paddle 81*b* is provided on both sides thereof. It is also possible to provide a third paddle different in phase in the circumferential direction from both of the first paddle 81*a* and the second paddle 81*b*. The third paddle can be provided, for example, further outside in the width direction with respect to the second paddle 81*b*.

The control unit 80 can control the paddle 81 and the feed roller pair 75 so as to make the circumferential speed of the paddle 81 faster than the circumferential speed of the driving roller 75*a* of the feed roller pair 75.

When it is necessary to rotate the paddle 81 in a state where the medium P is nipped by the feed roller pair 75, if the circumferential speed of the paddle 81 is slower than the circumferential speed of the feed roller pair 75, there is a possibility that the medium P is buckled between the paddle 81 and the feed roller pair 75. By making the circumferential speed of the paddle 81 faster than the circumferential speed of the driving roller, the possibility of the medium P being buckled between the paddle 81 and the feed roller pair 75 can be reduced.

The control unit 80 drives the paddle 81 after the upstream end E2 of the stacked media P passes the position receiving the feed force from the feed roller pair 75 illustrated in FIG. 3, that is, drives the paddle 81 after the upstream end E2 of the medium P comes out of the nip of the feed roller pair 75, thereby capable of avoiding the possibility of the medium P being buckled between the paddle 81 and the feed roller pair 75.

A device obtained by omitting the saddle-stitching function from the second unit 6 as a medium processing apparatus in the first embodiment can be regarded as the medium transport device 70. Also, an apparatus obtained by omitting the recording function from the recording system 1 can be regarded as the medium transport device 70 or the medium processing apparatus that performs saddle-stitching processing on the medium.

The medium transport device 70 can also be employed in a medium processing apparatus that performs not only saddle-stitching processing but also end-stitching processing and punching processing on a bundle of media having aligned ends.

Further, it is needless to say that the present disclosure is not limited to the embodiment described above and various modifications may be made thereto within the scope of the invention described in the claims, and various modifications are also included in the scope of the present disclosure.

What is claimed is:

1. A medium transport device comprising:

a feeding unit that transports a medium;

a stack portion that receives the medium transported by the feeding unit between a support surface for supporting the medium in an inclined posture in which a downstream side in a transport direction is directed downward and an opposing surface opposing the support surface and stacks the medium;

an alignment portion that aligns a downstream end of the medium stacked in the stack portion; and a control unit that controls a distance between the support surface and the opposing surface, wherein the stack portion is configured to be capable of changing the distance and the control unit adjusts the distance according to a condition including a discharge amount of liquid discharged to the medium for recording.

2. The medium transport device according to claim 1, wherein the control unit further uses, as the condition, any of a type of the medium to be stacked, the number of stacked media previously stacked in the stack portion, and a stack height of the medium previously stacked in the stack portion.

3. The medium transport device according to claim 1, wherein the control unit uses a plurality of conditions as the condition.

4. The medium transport device according to claim 3, wherein the plurality of conditions include one or more of a type of the medium to be stacked, a temperature in an installation environment of the device, a humidity in the installation environment, and the number of stacked media previously stacked in the stack portion.

5. The medium transport device according to claim 4, wherein the control unit uses the type of the medium and the number of stacked media previously stacked in the stack portion as the plurality of conditions, sets the distance between the support surface and the opposing surface to a first distance in stacking the medium when the number of stacked media is less than a predetermined threshold value according to the type of the medium, and sets the distance between the support surface and the opposing surface to a second distance longer than the first distance in stacking the medium when the number of stacked media is equal to or greater than the predetermined threshold value according to the type of the medium.

6. The medium transport device according to claim 4, wherein the control unit uses as the plurality of conditions the discharge amount of the liquid to the medium and the number of stacked media in the stack portion, sets the distance between the support surface and the opposing surface to a first distance in stacking the medium when the number of stacked media is less than a predetermined threshold value according to the discharge amount of the liquid to the medium, and sets the distance between the support surface and the opposing surface to a second distance longer than the first distance in stacking the medium when the number of stacked media is equal to or greater than the predetermined threshold value according to the discharge amount of the liquid to the medium.

7. The medium transport device according to claim 6, wherein the threshold value of the number of stacked media is set to be lower as the discharge amount of the liquid to the medium increases.

8. The medium transport device according to claim 1, wherein the distance between the support surface and the opposing surface is changed by displacing the opposing surface in an advancing and retreating direction in which the opposing surface advances and retreats with respect to the support surface.

9. The medium transport device according to claim 8, further comprising:

a paddle that is provided between the feeding unit and the alignment portion in the transport direction and moves the medium toward the alignment portion by rotating while being in contact with the medium, wherein the paddle is configured to be displaceable in the advancing and retreating direction, and is displaced in the same direction as a displacement direction of the opposing surface when the opposing surface is displaced.

10. The medium transport device according to claim 9, wherein the paddle includes a first paddle and a second paddle provided at an interval in a width direction intersecting the transport direction, and the first paddle and the second paddle are disposed such that phases in a circumferential direction of a rotation shaft are different from each other.

11. The medium transport device according to claim 1, wherein the alignment portion includes an eaves portion opposing a downstream end region of the medium stacked in the stack portion, and a distance between the eaves portion and the support surface is longer than the distance between the support surface and the opposing surface.

12. A medium processing apparatus comprising:

the medium transport device according to claim 1; and a processing unit that performs processing on the medium stacked in the stack portion.

13. The medium processing apparatus according to claim 12, wherein the processing unit includes a binding unit that binds the medium and a folding unit that folds the medium at a binding position by the binding unit.

14. A control method of a medium transport device, comprising:

transporting, by a feeding unit, a medium;

receiving, by a stack portion, the medium transported by the feeding unit between a support surface for supporting the medium in an inclined posture in which a downstream side in a transport direction is directed downward and an opposing surface opposing the support surface and stacking, by the stack portion, the medium;

aligning, by an alignment portion, a downstream end of the medium stacked in the stack portion; and controlling, by a control unit, a position of the opposing surface, wherein the control unit changes a distance between the support surface of the stack portion and the opposing surface according to a condition including a discharge amount of liquid discharged to the medium.

15. The control method of the medium transport device according to claim 14, wherein the control unit further uses, as the condition, any of a type of the medium to be stacked, the number of stacked media previously stacked in the stack portion, and a stack height of the media previously stacked in the stack portion.

16. The control method of the medium transport device according to claim 14, wherein the control unit uses a plurality of conditions as the condition.

17. The control method of the medium transport device according to claim 16, wherein the plurality of conditions include one or more of a type of the medium to be stacked, temperature in an installation environment of the device, a humidity in the installation environment, and the number of stacked media previously stacked in the stack portion.

18. The control method of the medium transport device according to claim 14, wherein the control unit changes the distance between the support surface and the opposing surface by displacing the opposing surface in an advancing and retreating direction in which the opposing surface advances and retreats with respect to the support surface.

19. The control method of the medium transport device according to claim 18, wherein the transport device includes a paddle that is provided between the feeding unit and the alignment portion in the transport direction and moves the medium toward the alignment portion by rotating while being in contact with the medium, the method further comprising:

moving, by the paddle, the medium toward the alignment portion, and the control unit displaces the paddle in the same direction as a displacement direction of the opposing surface when displacing the opposing surface.

20. A medium transport device comprising:

a feeding unit that transports a medium;

a stack portion that receives the medium transported by the feeding unit between a support surface for supporting the medium in an inclined posture in which a downstream side in a transport direction is directed downward and an opposing surface opposing the support surface and stacks the medium;

an alignment portion that aligns a downstream end of the medium stacked in the stack portion; and a control unit that controls a distance between the support surface and the opposing surface, wherein the stack portion is configured to be capable of changing the distance and the control unit adjusts the distance according to a condition including a discharge amount of liquid discharged to the medium for recording, wherein the distance between the support surface and the opposing surface is changed by displacing the opposing surface in an advancing and retreating direction in which the opposing surface advances and retreats with respect to the support surface, wherein the opposing surface is disposed above the support surface and adjacent to a set of folding rollers of the medium transport device, and wherein the support surface and the opposing surface are not part of the alignment portion.

* * * * *